US011258189B2

(12) United States Patent
Hashiguchi et al.

(10) Patent No.: US 11,258,189 B2
(45) Date of Patent: Feb. 22, 2022

(54) CONNECTOR AND CONNECTING METHOD

(71) Applicant: Japan Aviation Electronics Industry, Limited, Tokyo (JP)

(72) Inventors: Osamu Hashiguchi, Tokyo (JP); Tetsuya Komoto, Tokyo (JP); Akihiro Matsunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/922,389

(22) Filed: Jul. 7, 2020

(65) Prior Publication Data

US 2021/0104824 A1 Apr. 8, 2021

(30) Foreign Application Priority Data

Oct. 3, 2019 (JP) ..... JP2019-182609
Dec. 26, 2019 (JP) ..... JP2019-235491

(51) Int. Cl.
*H01R 4/48* (2006.01)
*H01R 13/502* (2006.01)

(52) U.S. Cl.
CPC ..... *H01R 4/48* (2013.01); *H01R 13/502* (2013.01)

(58) Field of Classification Search
CPC ... A41D 1/005; H01R 13/2471; H01R 13/665
See application file for complete search history.

(56) References Cited

U.S. PATENT DOCUMENTS 5,496,182 A 3/1996 Yasumura
9,893,478 B2 * 2/2018 Komoto ..... A41D 1/005
10,109,963 B2 * 10/2018 Komoto ..... H01R 13/5219
10,498,097 B2 * 12/2019 Komoto ..... H01R 13/5202
2002/0160648 A1 * 10/2002 Bulmer ..... H01R 12/675 439/393
2006/0280322 A1 * 12/2006 Abe ..... H01R 13/24 381/300

(Continued)

FOREIGN PATENT DOCUMENTS

GB 1522029 A 8/1978
JP 2018129244 A 8/2018

OTHER PUBLICATIONS

European Search Report dated Oct. 28, 2020 in EP Application No. 20189595.0 (19 pages).

(Continued)

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A connector includes a pushing member having a projection, a support member disposed to contact a lateral surface of the projection, and a contact made of a conductive material and having a support member facing portion facing the support member, a part of the flexible conductor being disposed between the support member and the support member facing portion of the contact, the lateral surface of the projection pressing the part of the flexible conductor against the support member facing portion of the contact via the support member, whereby the contact is electrically connected to the flexible conductor.

25 Claims, 24 Drawing Sheets

(56) References Cited

U.S. PATENT DOCUMENTS

| | | | | |
|---|---|---|---|---|
| 2009/0088652 | A1* | 4/2009 | Tremblay | A61B 5/6814 600/388 |
| 2017/0209738 | A1* | 7/2017 | Brennan | A41D 1/005 |
| 2017/0279230 | A1* | 9/2017 | Komoto | H01R 13/73 |
| 2018/0212359 | A1* | 7/2018 | Wei | H05K 1/181 |
| 2018/0233854 | A1* | 8/2018 | Komoto | H01R 13/629 |
| 2019/0027846 | A1 | 1/2019 | Hashiguchi | |

OTHER PUBLICATIONS

European Search Report dated Oct. 28, 2020 in EP Application No. 21089595.0 (19 pages).

Extended European Search Report issued in corresponding EP application No. EP 20 18 9595 with a completion date of Nov. 26, 2020.

* cited by examiner

CONNECTOR AND CONNECTING METHOD

BACKGROUND OF THE INVENTION

The present invention relates to a connector and a connecting method, particularly to a connector connected to a flexible conductor.

As a connector connected to a flexible conductor, for example, JP 2018-129244 A discloses a connector shown in FIG. 47. This connector includes a contact 2 and a base member 3 disposed on opposite sides across a flexible substrate 1 to sandwich the flexible substrate 1 therebetween.

A flexible conductor 4 is exposed on a top surface of the flexible substrate 1 facing the contact 2, the contact 2 has a recessed projection accommodating portion 5 formed to face the flexible conductor 4, and a projection 6 protruding toward a rear surface of the flexible substrate 1 is formed on the base member 3. When the projection 6 of the base member 3 is inserted into the projection accommodating portion 5 of the contact 2 together with the flexible substrate 1 with the flexible substrate 1 being sandwiched between the projection 6 and the contact 2 so that the projection 6 is covered with the flexible substrate 1, the flexible substrate 1 is pressed against an inner surface of the projection accommodating portion 5 of the contact 2 by the projection 6, and the inner surface of the projection accommodating portion 5 comes into contact with the flexible conductor 4 exposed on the top surface of the flexible substrate 1 with predetermined contact force, whereby the contact 2 is electrically connected to the flexible conductor 4.

However, when the projection 6 of the base member 3 is inserted into the projection accommodating portion 5 of the contact 2 together with the flexible substrate 1, the flexible substrate 1 receives, from the projection 6, large force acting as the predetermined contact force between the flexible conductor 4 and the inner surface of the projection accommodating portion 5 in a connected state, and is inserted while rubbing against the inner surface of the projection accommodating portion 5. Therefore, the flexible conductor 4 disposed on the top surface of the flexible substrate 1 may be damaged, and reliability of the electrical connection between the flexible conductor 4 and the contact 2 may be impaired.

SUMMARY OF THE INVENTION

The present invention has been made to solve such a conventional problem, and an object thereof is to provide a connector capable of preventing damage of a flexible conductor at the time of connection and securing reliability of electrical connection to the flexible conductor.

Another object of the present invention is to provide a connecting method for electrically connecting a contact to a flexible conductor while preventing damage of the flexible conductor.

A first connector according to the present invention is a connector to be connected to a flexible conductor, comprising:

a pushing member having a projection;

a support member disposed to contact a lateral surface of the projection; and a contact made of a conductive material and having a support member facing portion facing the support member, wherein a part of the flexible conductor is disposed between the support member and the support member facing portion of the contact, and the lateral surface of the projection presses the part of the flexible conductor against the support member facing portion of the contact via the support member, whereby the contact is electrically connected to the flexible conductor.

A connecting method according to the present invention is a method for connecting a contact to a flexible conductor, comprising:

disposing a part of the flexible conductor between a support member and a support member facing portion of the contact; and making a lateral surface of a projection of a pushing member contact the support member to allow the lateral surface of the projection to press the part of the flexible conductor against the support member facing portion of the contact via the support member, whereby the contact is electrically connected to the flexible conductor.

A second connector according to the present invention is a connector to be connected to a flexible conductor extending along a predetermined arrangement plane, comprising:

a pushing member having a projection; and a contact made of a conductive material and including a conductor contact surface in a planar shape orthogonal to the arrangement plane and a counter connector contact surface that faces in a direction opposite to the conductor contact surface and is to contact a contact of a counter connector, wherein a part of the flexible conductor is disposed between the projection and the conductor contact surface of the contact in a state of being bent in a direction orthogonal to the arrangement plane, and a lateral surface of the projection presses the part of the flexible conductor against the conductor contact surface of the contact, whereby the contact is electrically connected to the flexible conductor.

DETAILED DESCRIPTION OF THE INVENTION

Hereinafter, embodiments of the present invention will be described with reference to the accompanying drawings.

Embodiment 1

Figure 1:
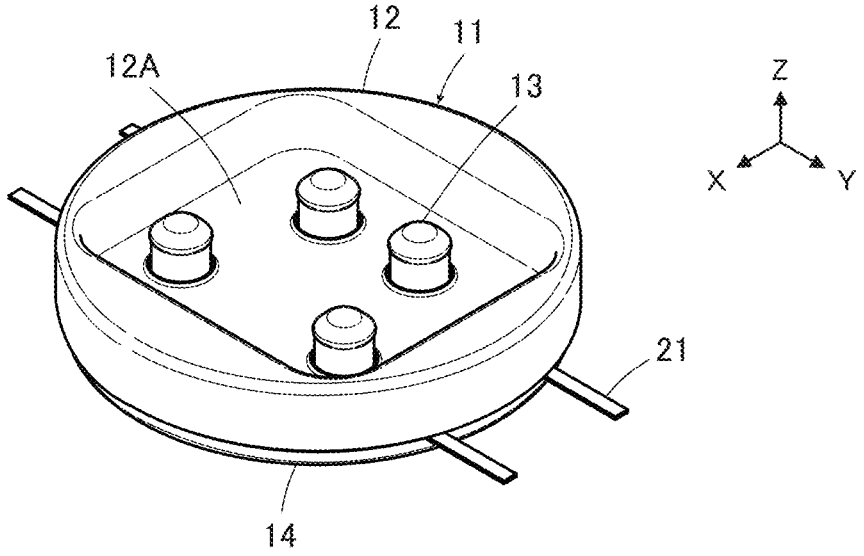
FIG. 1 is a perspective view of a connector according to Embodiment 1 of the present invention as viewed obliquely from above.
Figure 2:
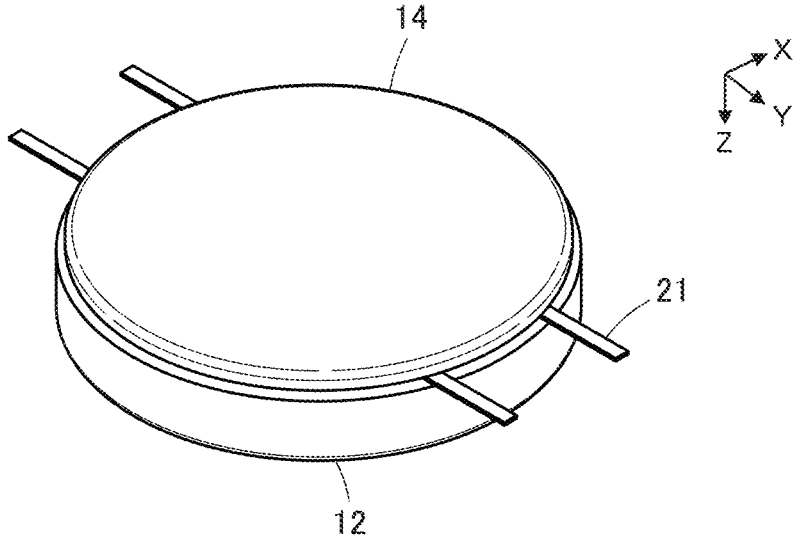
FIG. 2 is a perspective view of the connector according to Embodiment 1 as viewed obliquely from below.

FIGS. 1 and 2 show a connector 11 according to Embodiment 1. The connector 11 is used, for example, as a garment-side connector portion for fitting a wearable device, and is connected to a plurality of flexible conductors 21.

The connector 11 includes a housing 12, four contacts 13, and a base member 14 facing the housing 12 with the four flexible conductors 21 being sandwiched therebetween, and the four contacts 13 and the four flexible conductors 21 are electrically connected to each other. The housing 12 has a recess 12A, and the plurality of contacts 13 protrude perpendicularly to a planar bottom surface of the recess 12A within the recess 12A of the housing 12.

As the flexible conductor 21, a band-shaped conductor made by twisting a plurality of conductive fibers is used.

Here, for convenience, the bottom surface of the recess 12A of the housing 12 is defined as extending along an XY plane, and a direction in which the contacts 13 protrude is referred to as a +Z direction.

The four flexible conductors 21 are disposed on a −Z direction side of the housing 12, and the base member 14 is disposed on the −Z direction side of the four flexible conductors 21.

Figure 3:
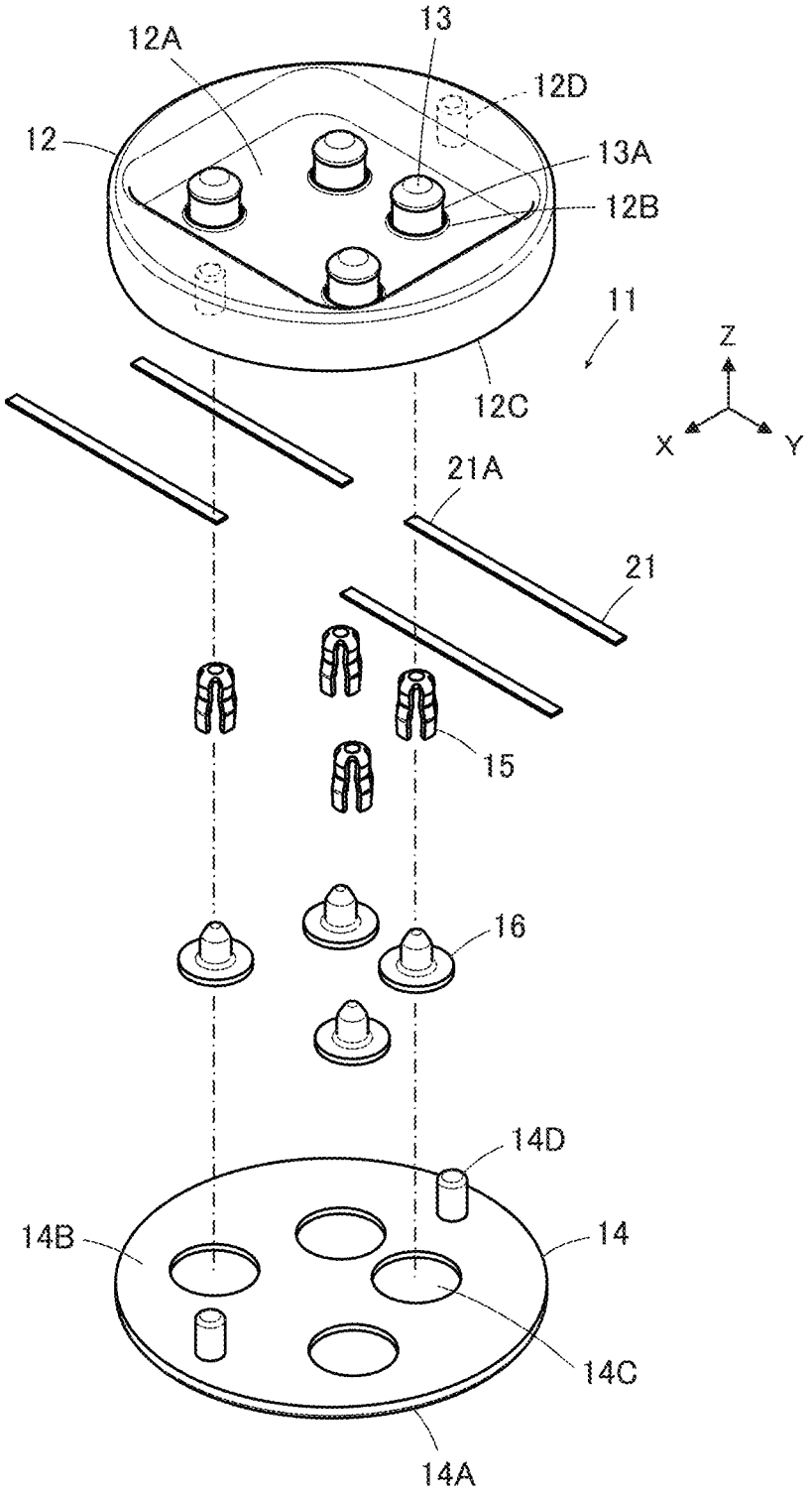
FIG. 3 is an assembly view of the connector according to Embodiment 1 as viewed obliquely from above.
Figure 4:
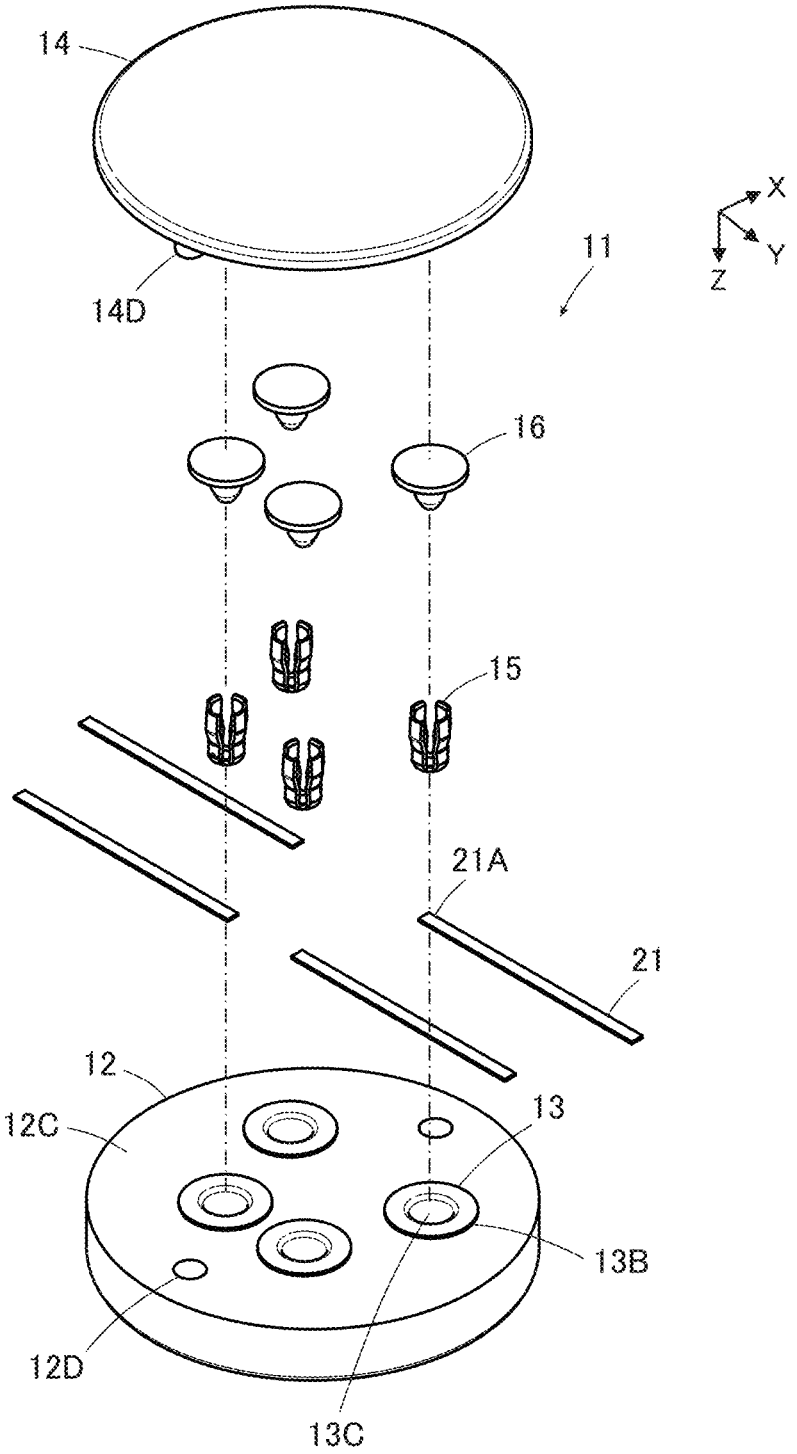
FIG. 4 is an assembly view of the connector according to Embodiment 1 as viewed obliquely from below.

FIGS. 3 and 4 show assembly views of the connector 11. The housing 12 is made of an insulating material such as insulating resin and is provided with four contact through-holes 12B within the recess 12A opening in the +Z direction. The recess 12A constitutes a counter connector accommodating portion in which a part of a counter connector (not shown) is accommodated. The contacts 13 are separately inserted in the four contact through-holes 12B. Further, two recessed post accommodating portions 12D are formed at positions outside the recess 12A in an XY direction and at a surface 12C of the housing 12 facing in a −Z direction.

The four contacts 13 are plug-type contacts made of a conductive material such as metal, and are connected to corresponding contacts of the counter connector (not shown) when the part of the counter connector is accommodated in the recess 12A of the housing 12.

The four flexible conductors 21 are disposed on the −Z direction side of the housing 12, and four support members 15 are disposed on the −Z direction side of the four flexible conductors 21. Further, four pushing members 16 are disposed on the −Z direction side of the four support members 15.

The base member 14 is made of an insulating material such as insulating resin and has a flat plate portion 14A. Four pushing member recesses 14C corresponding to the four pushing members 16 are formed at a surface 14B of the flat plate portion 14A facing in the +Z direction. Further, two housing fixing posts 14D protrude from the surface 14B of the flat plate portion 14A. These two housing fixing posts 14D correspond to the two recessed post accommodating portions 12D of the housing 12.

The four contacts 13 inserted in the four contact through-holes 12B of the housing 12, bendable contact point portions 21A disposed at one ends of the four flexible conductors 21, the four support members 15, the four pushing members 16, and the four pushing member recesses 14C of the base member 14 are disposed at positions that are aligned with each other in a Z direction.

The two post accommodating portions 12D of the housing 12 and the two housing fixing posts 14D of the base member 14 are disposed at positions that are aligned with each other in the Z direction.

Figure 5:
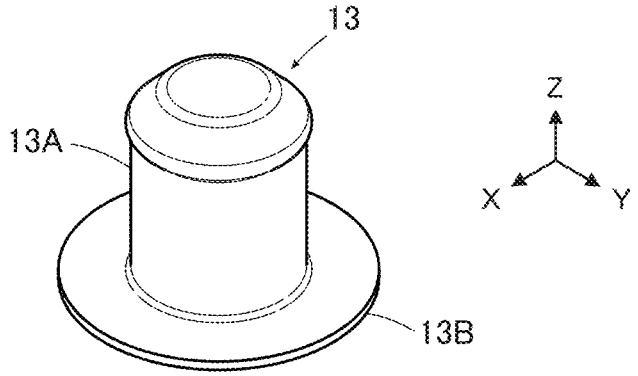
FIG. 5 is a perspective view of a contact used in the connector according to Embodiment 1 as viewed obliquely from above.
Figure 6:
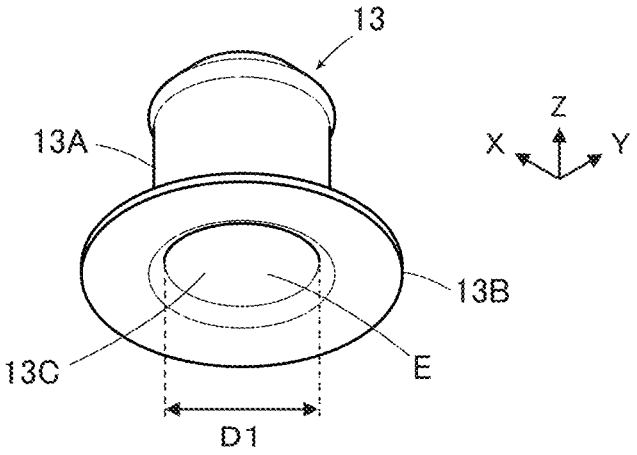
FIG. 6 is a perspective view of the contact used in the connector according to Embodiment 1 as viewed obliquely from below.

As shown in FIGS. 5 and 6, the contact 13 has a protruding portion 13A in the shape of a cylindrical tube extending in the Z direction and a disk-shaped contact-side flange 13B extending from a −Z directional end of the protruding portion 13A along the XY plane. Inside the protruding portion 13A, there is formed a recessed support member accommodating portion 13C opening in the −Z direction. In other words, the contact-side flange 13B is formed to surround an opening end of the support member accommodating portion 13C. The support member accommodating portion 13C has an inside diameter D1, and a support member facing portion E that is to face the support member 15 is formed by an inner surface of the support member accommodating portion 13C.

Such a contact 13 can be manufactured by, for example, press working, cutting, drawing, or the like.

The contact through-hole 12B of the housing 12 has an inside diameter larger than an outside diameter of the protruding portion 13A of the contact 13 and smaller than an outside diameter of the contact-side flange 13B thereof. As shown in FIG. 3, the protruding portions 13A of the contacts 13 protrude to the inside of the recess 12A of the housing 12 through the contact through-holes 12B, and as shown in FIG. 4, the contact-side flanges 13B of the contacts 13 are exposed on the surface 12C of the housing 12 facing in the −Z direction.

Figure 7:
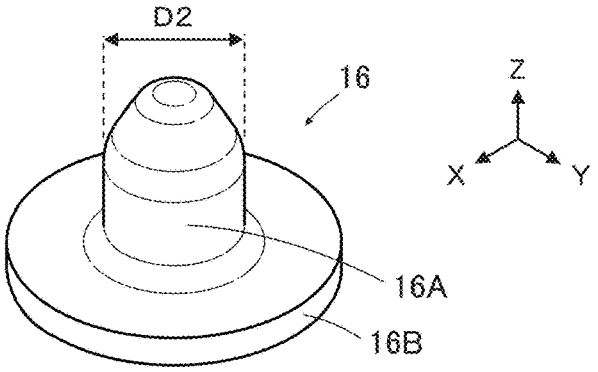
FIG. 7 is a perspective view showing a pushing member used in the connector according to Embodiment 1.

As shown in FIG. 7, the pushing member 16 has a projection 16A in the shape of a substantially cylindrical column extending in the +Z direction and a disk-shaped pushing member-side flange 16B extending from a −Z directional end of the projection 16A along the XY plane. The projection 16A has an outside diameter D2.

Figure 8:
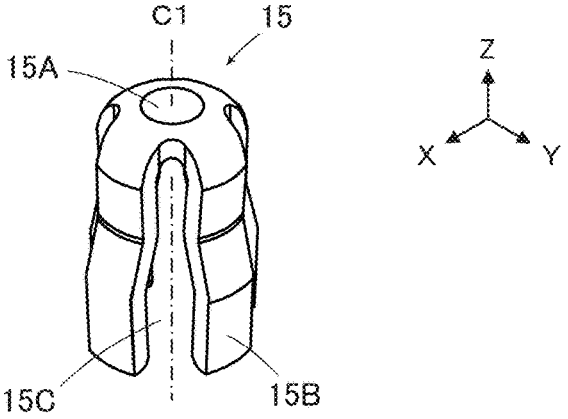
FIG. 8 is a perspective view showing a support member used in the connector according to Embodiment 1.

As shown in FIG. 8, the support member 15 is to be accommodated in the support member accommodating portion 13C of the contact 13, is made of elastically deformable resin or metal, and has a central axis C1 extending in the Z direction. The support member 15 has a base portion 15A disposed on the central axis C1 and four cantilever-shaped elastic pieces 15B connected to the base portion 15A and extending from the base portion 15A in the −Z direction substantially parallel to the central axis C1. When the support member 15 is accommodated in the support member accommodating portion 13C of the contact 13, the base portion 15A faces a bottom of the support member accommodating portion 13C in the Z direction. The four elastic pieces 15B have the same shape with each other and are arranged at equal intervals in a circumferential direction around the central axis C1, and a recessed projection inserting portion 15C opening in the −Z direction is formed inside the four elastic pieces 15B.

Figure 9:
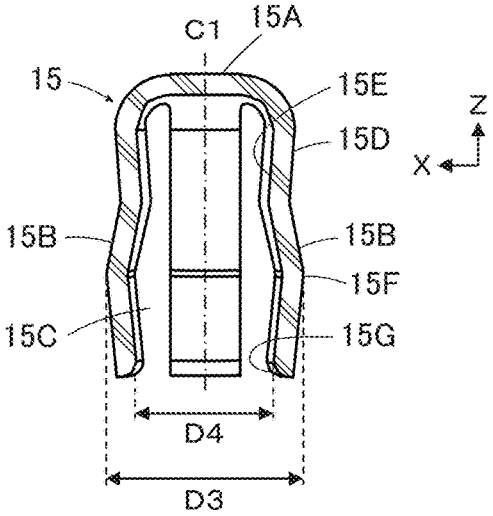
FIG. 9 is a sectional view of the support member used in the connector according to Embodiment 1.

As shown in FIG. 9, each elastic piece 15B has an outer surface 15D facing a direction away from the central axis C1 and an inner surface 15E facing the central axis C1. A conductor contact portion 15F that is bent and protrudes in the direction away from the central axis C1 is formed on the outer surface 15D, and a projection contact portion 15G is formed on the inner surface 15E at a −Z directional end of the elastic piece 15B.

In the XY plane, when a diameter of a circle drawn around the central axis C1 and in contact with the outer surfaces 15D of the four elastic pieces 15B is defined as an outside diameter (outside dimension) of the support member 15, the support member 15 has a maximum outside diameter D3 at a Z direction position where the conductor contact portions 15F are disposed. The outside diameter D3 at the conductor contact portions 15F is set to be smaller than a value obtained by subtracting a thickness of the flexible conductor 21 from the inside diameter D1 of the support member accommodating portion 13C of the contact 13.

Further, in the XY plane, when a diameter of a circle drawn around the central axis C1 and in contact with the inner surfaces 15E of the four elastic pieces 15B is defined as an inside diameter (inside dimension) of the support member 15, an inside diameter D4 of the support member 15 at the −Z directional ends of the elastic pieces 15B where the projection contact portions 15G are disposed is set to be smaller than the outside diameter D2 of the projection 16A having the cylindrical column shape of the pushing member 16.

Figure 10:
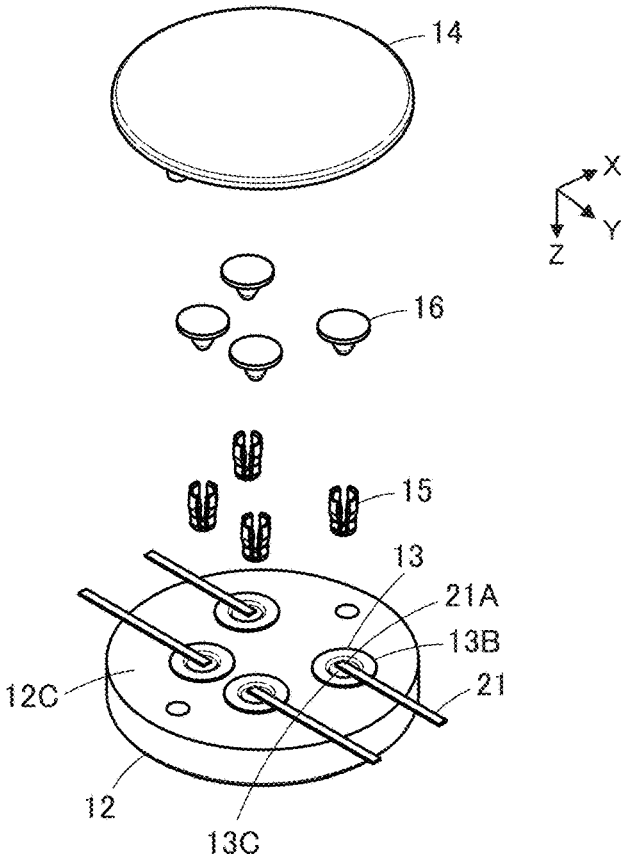
FIG. 10 is an assembly view of a stage in which flexible conductors are disposed on a housing in which the contacts are fitted.

When the connector 11 is connected to the plurality of flexible conductors 21, first, the protruding portions 13A of the four contacts 13 are inserted into the four contact through-holes 12B of the housing 12. At this time, as shown in FIG. 10, the contact-side flanges 13B of the four contacts 13 are exposed on the surface 12C of the housing 12 facing in the −Z direction.

Next, the four flexible conductors 21 are disposed on the surface 12C of the housing 12 so that the contact point portions 21A of the flexible conductors 21 are located on the recessed support member accommodating portions 13C of the corresponding contacts 13.

Figure 11:
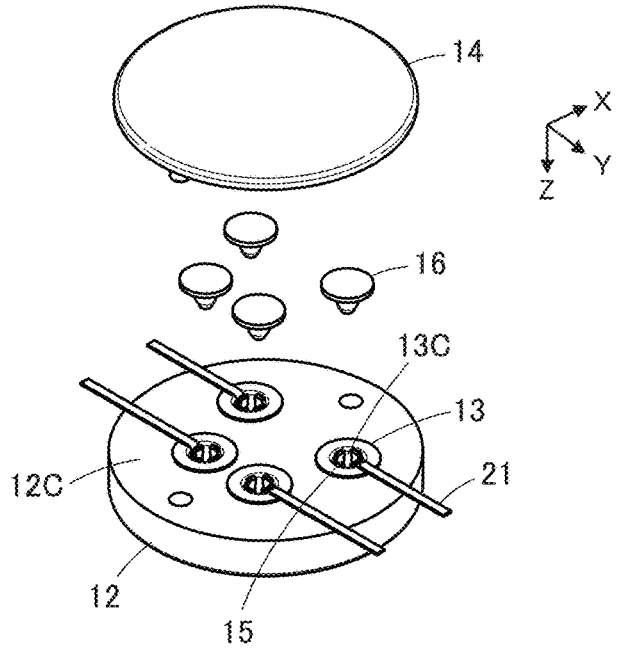
FIG. 11 is an assembly view of a stage in which the support members are accommodated in support member accommodating portions of the contacts.
Figure 12:
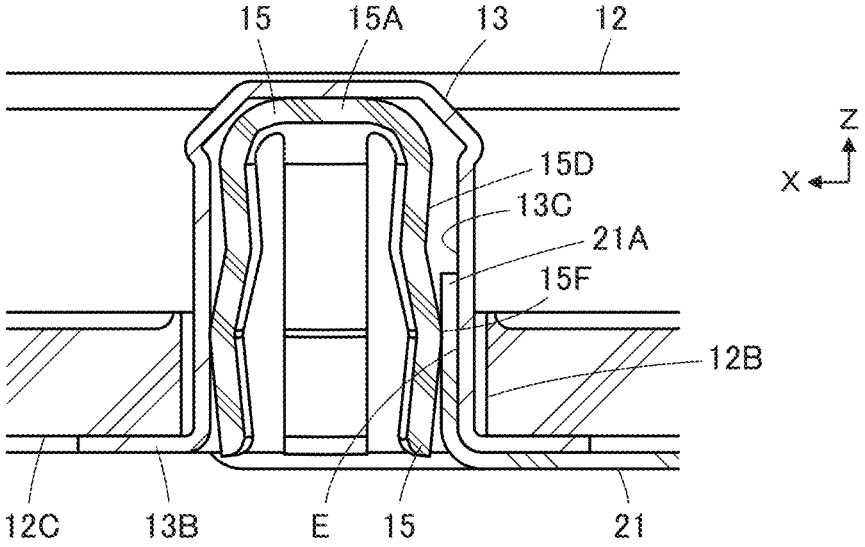
FIG. 12 is a partial sectional view showing a state in which the support member is accommodated in the support member accommodating portion of the contact.

In this state, as shown in FIG. 11, the support members 15 are inserted correspondingly into the support member accommodating portions 13C of the four contacts 13 from the −Z direction. Thus, as shown in FIG. 12, the contact point portion 21A of the flexible conductor 21 is bent in the +Z direction and inserted into the support member accommodating portion 13C of the contact 13 together with the support member 15, and is disposed to be sandwiched between the outer surface 15D of the elastic piece 15B of the support member 15 and the support member facing portion E formed by the inner peripheral surface of the support member accommodating portion 13C.

Here, even at the Z direction position where the conductor contact portions 15F having the maximum outside diameter D3 are disposed, since the maximum outside diameter D3 of the support member 15 is set to be smaller than the value obtained by subtracting the thickness of the flexible conductor 21 from the inside diameter D1 of the support member accommodating portion 13C of the contact 13, the contact point portion 21A of the flexible conductor 21 is smoothly inserted into the support member accommodating portion 13C without being rubbed by receiving large force from the support member 15.

The base portion 15A of the support member 15 inserted into the support member accommodating portion 13C of the contact 13 comes into contact with the bottom of the support member accommodating portion 13C at a +Z directional end thereof, and almost the entire support member 15 is accommodated in the support member accommodating portion 13C.

Figure 13:
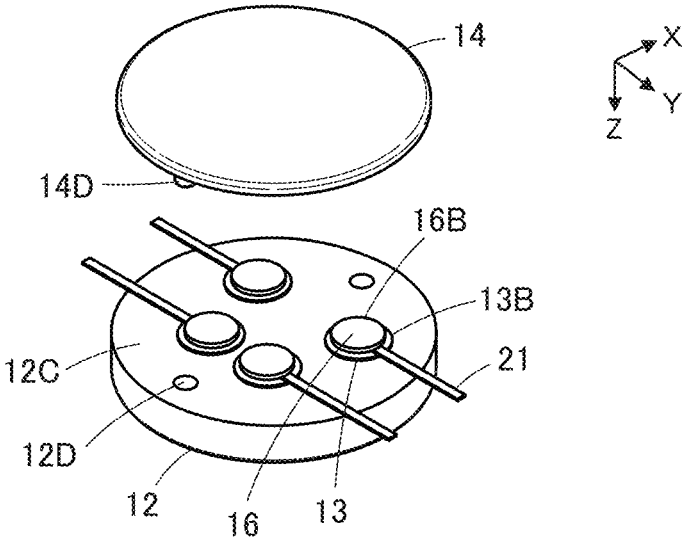
FIG. 13 is an assembly view of a stage in which projections of the pushing members are inserted into projection inserting portions of the support members.

Further, the projection 16A of each pushing member 16 is inserted from the −Z direction into the recessed projection inserting portion 15C of the corresponding support member 15 accommodated in the support member accommodating portion 13C of the corresponding contact 13, and a lateral surface of the projection 16A comes into contact with the support member 15. As a result, as shown in FIG. 13, the pushing member-side flanges 16B of the pushing members 16 are disposed on the contact-side flanges 13B of the four contacts 13, correspondingly.

Thereafter, the two housing fixing posts 14D of the base member 14 are inserted into the two post accommodating portions 12D of the housing 12, and the housing 12 and the base member 14 are bonded to each other with an adhesive in a state where the surface 12C of the housing 12 on the −Z direction side and the surface 14B of the flat plate portion 14A of the base member 14 facing in the +Z direction face each other with the flexible conductor 21 being sandwiched therebetween. Thus, a connecting process of the connector 11 to the flexible conductors 21 is completed.

Figure 14:
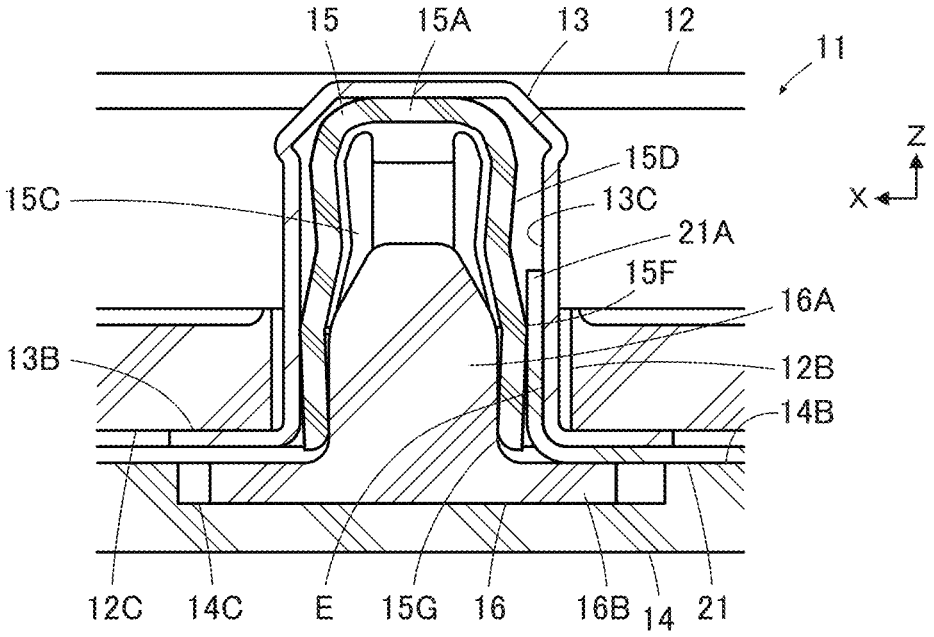
FIG. 14 is a partial sectional view showing the connector according to Embodiment 1.

FIG. 14 shows the connector 11 that has been connected to the flexible conductor 21 in this manner.

The inside diameter D4 of the support member 15 at the −Z directional ends of the elastic pieces 15B where the projection contact portions 15G are disposed is set to be smaller than the outside diameter D2 of the projection 16A having the cylindrical column shape of the pushing member 16. Accordingly, when the projection 16A is inserted into the projection inserting portion 15C of the support member 15, the four cantilever-shaped elastic pieces 15B of the support member 15 are elastically deformed to be expanded with the projection contact portions 15G being in contact with the lateral surface of the projection 16A. As a result, expanding force also acts on the conductor contact portion 15F of the elastic piece 15B, of the four elastic pieces 15B, facing the contact point portion 21A of the flexible conductor 21, and the contact point portion 21A of the flexible conductor 21 receives pressing force from the conductor contact portion 15F of the elastic piece 15B toward the inner peripheral surface of the support member accommodating portion 13C of the contact 13.

In other words, the lateral surface of the projection 16A inserted in the projection inserting portion 15C of the support member 15 presses the contact point portion 21A of the flexible conductor 21 against the support member facing portion E of the support member accommodating portion 13C of the contact 13 via the support member 15. As a result, the contact 13 is electrically connected to the flexible conductor 21.

Here, when the projection 16A of the pushing member 16 is inserted into the projection inserting portion 15C of the support member 15, an inner surface of the projection inserting portion 15C and the lateral surface of the projection 16A rub against each other. However, the contact point portion 21A of the flexible conductor 21 only receives the pressing force by being sandwiched between the outer surface 15D of the elastic piece 15B of the support member 15 and the inner peripheral surface of the support member accommodating portion 13C of the contact 13, and is not rubbed against any of the lateral surface of the projection 16A, the outer surface 15D of the elastic piece 15B, and the inner peripheral surface of the support member accommodating portion 13C.

The pushing member-side flange 16B of the pushing member 16 is covered with the base member 14 from the −Z direction and is accommodated in the pushing member recess 14C formed at the surface 14B of the flat plate portion 14A of the base member 14. Thus, the projection 16A of the pushing member 16 is prevented from coming off from the projection inserting portion 15C of the support member 15 in the −Z direction.

As described above, with the connector 11 according to Embodiment 1, even when the contact point portion 21A of the flexible conductor 21 is inserted into the support member accommodating portion 13C of the contact 13 together with the support member 15, and even when the projection 16A of the pushing member 16 is inserted into the projection inserting portion 15C of the support member 15, the contact point portion 21A of the flexible conductor 21 is not rubbed by receiving large force. Therefore, the flexible conductor 21 is prevented from being damaged, and reliability of electrical connection between the flexible conductor 21 and the contact 13 can be ensured.

While the connector 11 has the four contacts 13 in Embodiment 1 above, the present invention is not limited thereto. The present invention can be applied to a connector having one or more contacts 13.

Figure 15:
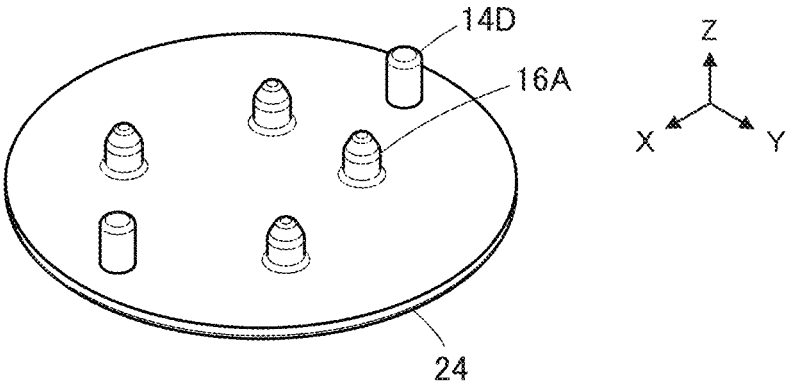
FIG. 15 is a perspective view showing a pushing member used in a connector according to a modification of Embodiment 1.

Also, in Embodiment 1 above, the four pushing members 16 are disposed independently of each other to correspond to the four contacts 13, and the base member 14 is fixed to the housing so as to cover the pushing member-side flanges 16B of the four pushing members 16. However, as shown in FIG. 15, a base member 24 from which four projections 16A protrude can be used in place of the base member 14 and the four pushing members 16. The four projections 16A are disposed at positions corresponding to the four contact through-holes 12B of the housing 12. Further, similarly to the base member 14, two housing fixing posts 14D are formed on the base member 24.

The support members 15 are inserted into the support member accommodating portions 13C of the four contacts 13, correspondingly, together with the contact point portions 21A of the corresponding flexible conductors 21, and the contact point portions 21A of the flexible conductors 21 are disposed to be sandwiched between the support members 15 and the support member facing portions E of the contacts 13. In this state, the base member 24 is pressed toward the housing 12 from the −Z direction while the two housing fixing posts 14D are inserted into the two post accommodating portions 12D of the housing 12.

Thus, the four projections 16A of the base member 24 are inserted into the projection inserting portions 15C of the corresponding support members 15, and the four contacts 13 are electrically connected to the four flexible conductors 21.

By using the base member 24 from which the four projections 16A protrude as above, the connector 11 can be more easily connected to the four flexible conductors 21.

Further, in Embodiment 1 above, the flexible conductor 21 is independently disposed between the support member 15 and the support member facing portion E of the contact 13 without being supported by, for example, an insulating substrate body. However, the present invention is not limited thereto, and the connector according to the present invention can be connected to the flexible conductor 21 disposed to be exposed on a top surface of a substrate body made of an insulating material. However, in order to electrically connect the contact 13 to the flexible conductor 21, the flexible conductor 21 needs to be disposed between the support member 15 and the support member facing portion E of the contact 13 such that the flexible conductor 21 faces the support member facing portion E of the contact 13 and a rear surface of the substrate body made of the insulating material faces the support member 15.

Embodiment 2

Figure 16:
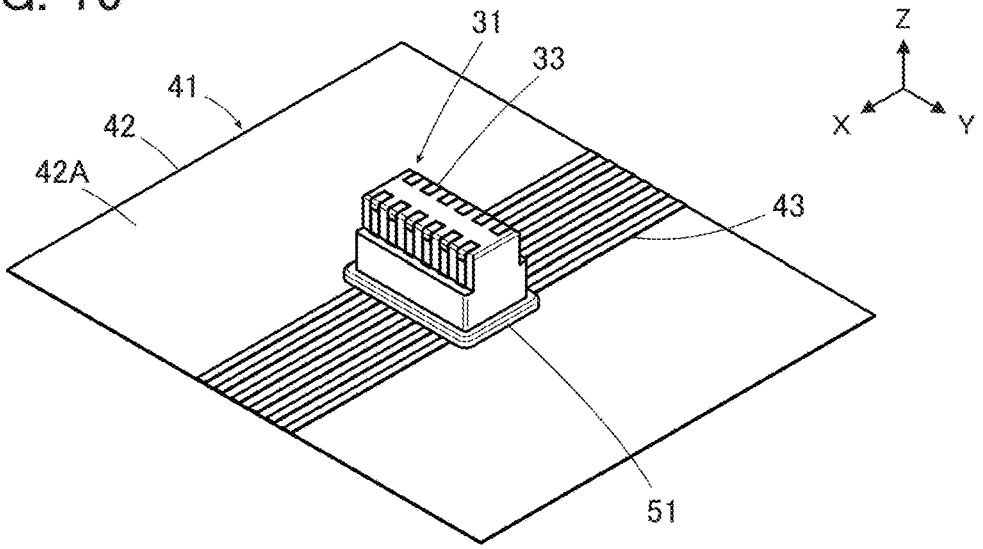
FIG. 16 is a perspective view of a connector according to Embodiment 2 as viewed obliquely from above.
Figure 17:
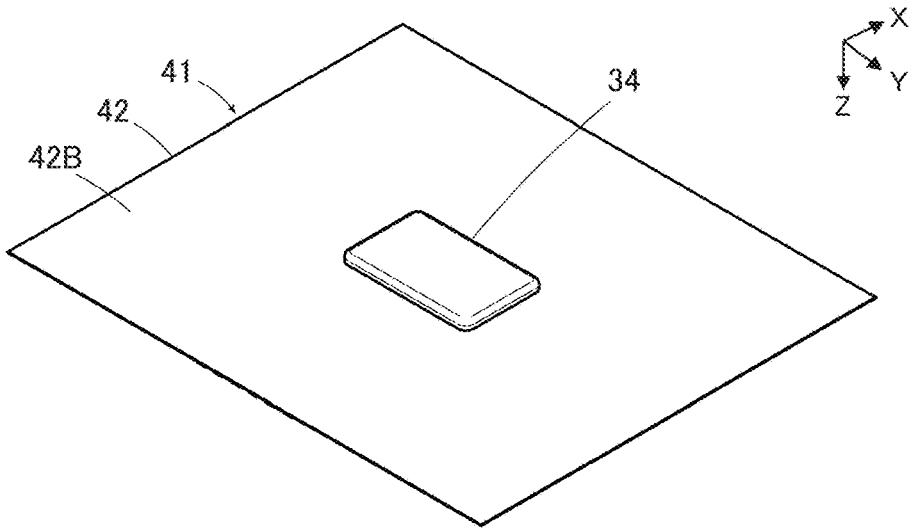
FIG. 17 is a perspective view of the connector according to Embodiment 2 as viewed obliquely from below.
Figure 18:
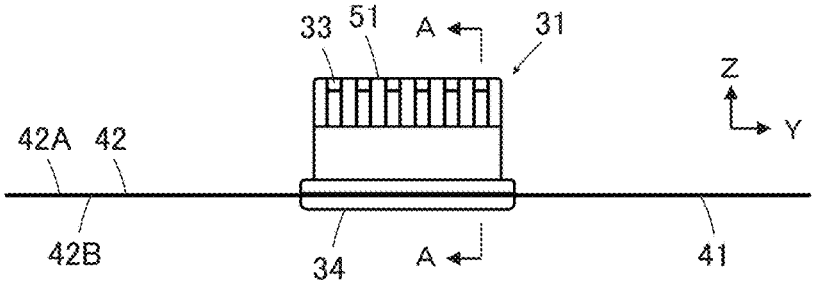
FIG. 18 is a front view of the connector according to Embodiment 2.

FIGS. 16 to 18 show a connector 31 according to Embodiment 2. The connector 31 is used, for example, as a garment-side connector portion for fitting a wearable device similarly to the connector 11 of Embodiment 1, and is attached to a flexible substrate 41.

The connector 31 includes a contact unit 51 disposed on a surface of the flexible substrate 41 and having a plurality of contacts 33 and a base member 34 facing the contact unit 51 with the flexible substrate 41 being sandwiched therebetween.

The flexible substrate 41 has a sheet-shaped substrate body made of an insulating material and extending along an arrangement plane with an XY plane being defined as the arrangement plane, and the substrate body 42 has a top surface 42A facing in a +Z direction and a rear surface 42B facing in a −Z direction. A plurality of flexible conductors 43 are disposed to be exposed on the top surface 42A of the substrate body 42. The plurality of flexible conductors 43 are, for example, band-like or thread-like conductors made of conductive fiber, extend in an X direction, and are arranged in a Y direction parallel to each other.

Further, the flexible conductors 43 can also be formed of conductive paste applied onto the top surface 42A of the substrate body 42 by printing or the like.

The contact unit 51 is disposed to protrude above the top surface 42A of the substrate body 42 of the flexible substrate 41.

Here, for convenience, the top surface 42A of the substrate body 42 of the flexible substrate 41 is defined as extending along the XY plane, and a direction in which the contact unit 51 protrudes is referred to as the +Z direction.

Figure 19:
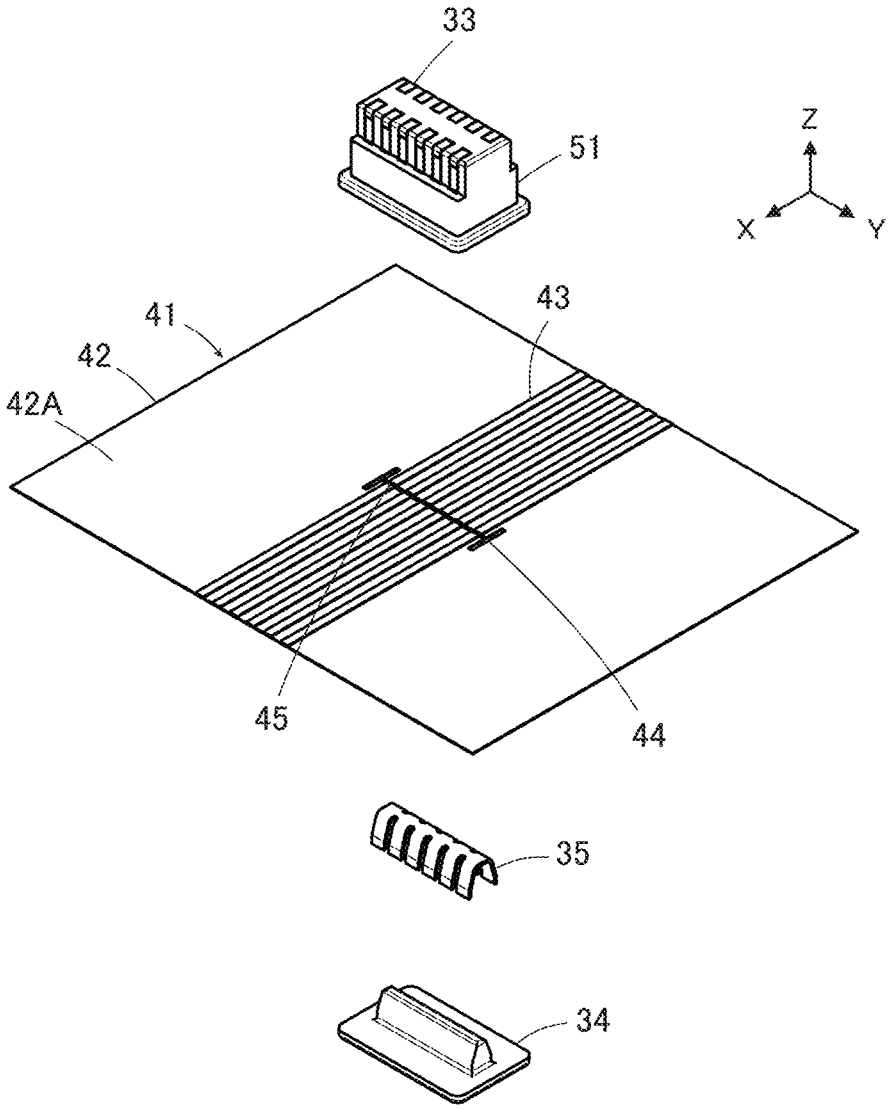
FIG. 19 is an assembly view of the connector according to Embodiment 2 as viewed obliquely from above.
Figure 20:
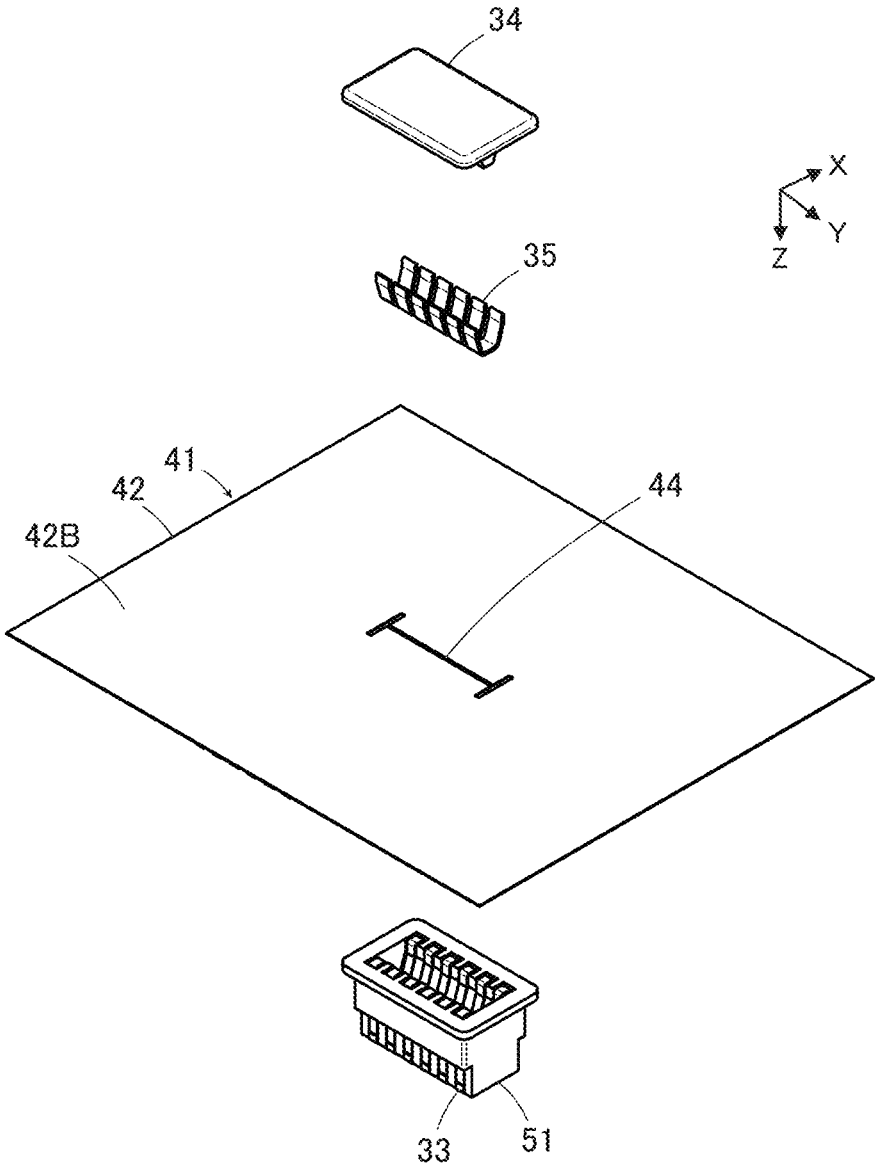
FIG. 20 is an assembly view of the connector according to Embodiment 2 as viewed obliquely from below.

FIGS. 19 and 20 show assembly views of the connector 31. The flexible substrate 41 is disposed on a −Z direction side of the contact unit 51. The flexible substrate 41 has an H-shaped cut 44, and the plurality of flexible conductors 43 are disposed parallel to each other on the top surface 42A of the substrate body 42 on a +X direction side and a −X direction side of the cut 44. One end of each flexible conductor 43 extends to the cut 44 to form a bendable contact point portion 45.

A support member 35 is disposed on the −Z direction side of the flexible substrate 41, and the base member 34 is disposed on the −Z direction side of the support member 35.

Figure 21:
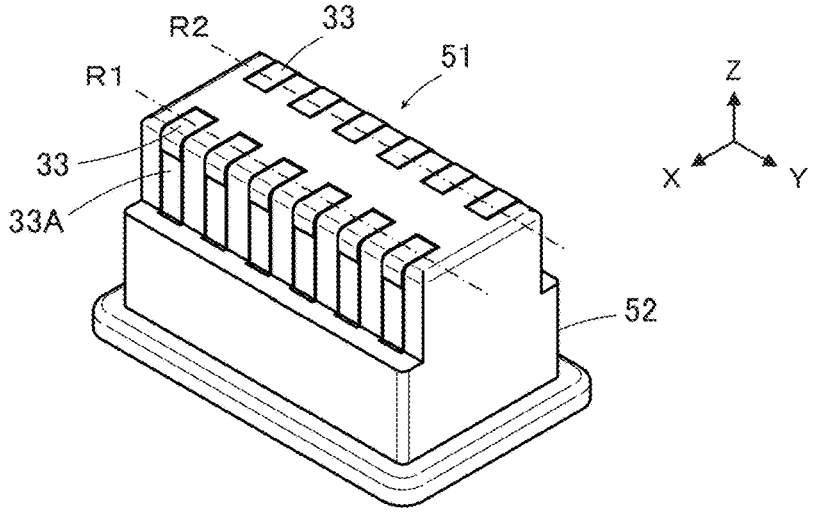
FIG. 21 is a perspective view of a contact unit used in the connector according to Embodiment 2 as viewed obliquely from above.
Figure 22:
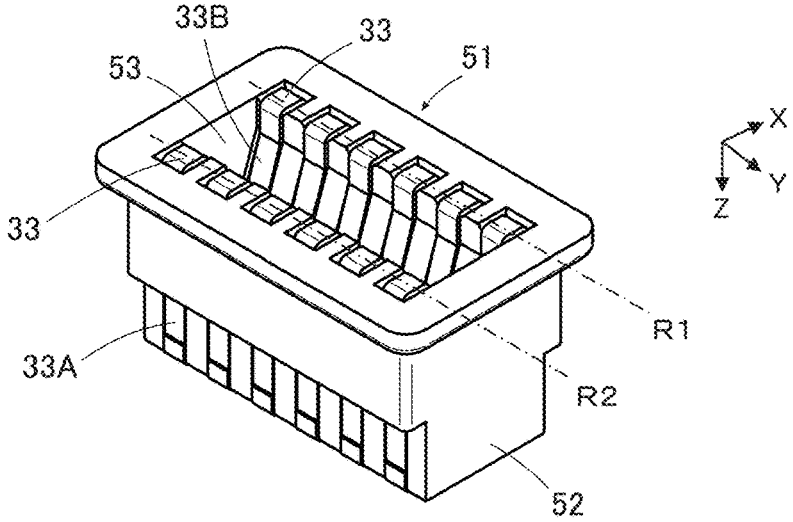
FIG. 22 is a perspective view of the contact unit used in the connector according to Embodiment 2 as viewed obliquely from below.

As shown in FIGS. 21 and 22, the contact unit 51 is configured such that the plurality of contacts 33 arranged in two rows including a first row R1 and a second row R2 are held by a housing 52. The plurality of contacts 33 forming the rows of the first row R1 and the second row R2 are aligned in the Y direction, and a plurality of contacts 33 forming the first row R1 and a plurality of contacts 33 forming the second row R2 are arranged to be adjacent to each other in the X direction.

Figure 23:
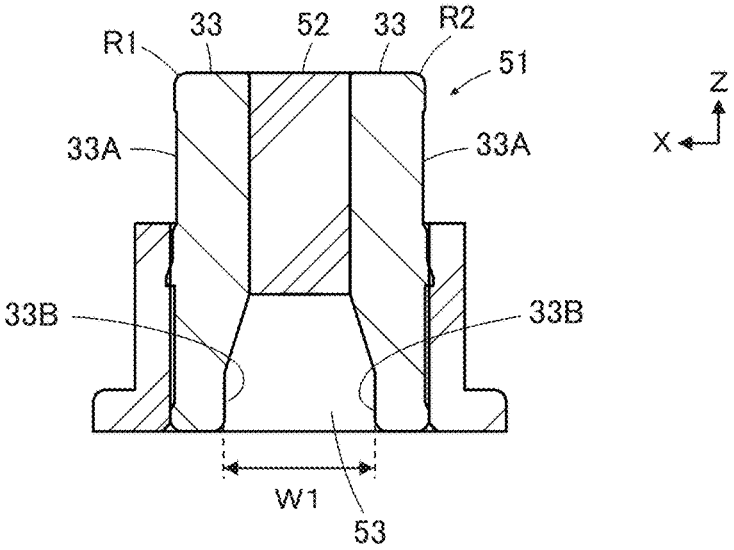
FIG. 23 is a sectional view showing the contact unit used in the connector according to Embodiment 2.

Each contact 33 is a plug-type contact made of a conductive material such as metal, is connected to a corresponding contact of a counter connector (not shown), and has a flat plate shape extending in the Z direction as shown in FIG. 23. More specifically, each of the plurality of contacts 33 constituting the first row R1 has a contact portion 33A formed on an end surface in the +X direction in a +Z directional end part and a support member facing portion 33B formed in a −Z directional end part and on an end surface in the −X direction. On the other hand, each of the plurality of contacts 33 constituting the second row R2 has a contact portion 33A formed on an end surface in the −X direction in the +Z directional end part and a support member facing portion 33B formed in the −Z directional end part and on an end surface in the +X direction.

Each contact 33 is held by the housing 52 such that the contact portion 33A and the support member facing portion 33B are exposed.

Further, the support member facing portion 33B of the contact 33 in the first row R1 and the support member facing portion 33B of the contact 33 in the second row R2 face each other. A recessed support member accommodating portion 53 extending in the Y direction and opening in the −Z direction is formed between the support member facing portions 33B of the plurality of contacts 33 constituting the first row R1 and the support member facing portions 33B of the plurality of contacts constituting the second row R2. The support member accommodating portion 53 has a width W1 in the X direction at its −Z directional end.

Figure 24:
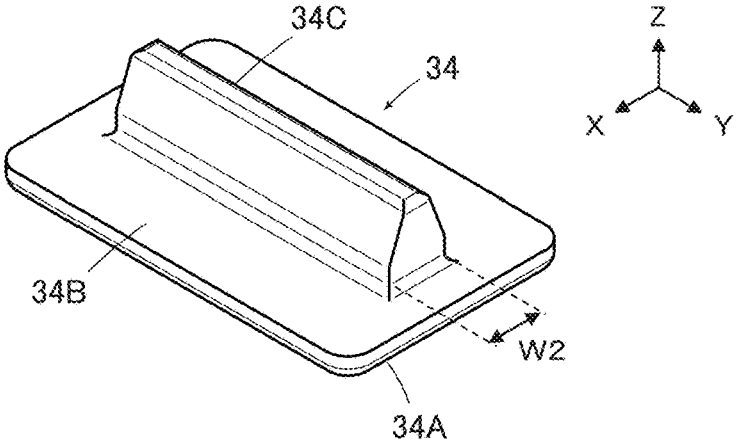
FIG. 24 is a perspective view showing a base member used in the connector according to Embodiment 2.

As shown in FIG. 24, the base member 34 is made of an insulating material such as insulating resin and has a flat plate portion 34A. One projection 34C common to the plurality of contacts 33 of the contact unit 51 is formed on a surface 34B of the flat plate portion 34A facing in the +Z direction. The projection 34C extends in the Y direction and protrudes in the +Z direction, has a shape in which a width in the X direction becomes narrower toward the +Z direction, and has a width W2 in the X direction at its −Z directional end.

Figure 25:
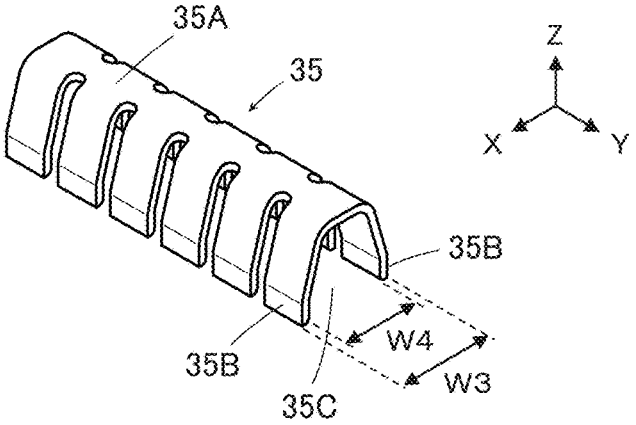
FIG. 25 is a perspective view of a support member used in the connector according to Embodiment 2 as viewed obliquely from above.
Figure 26:
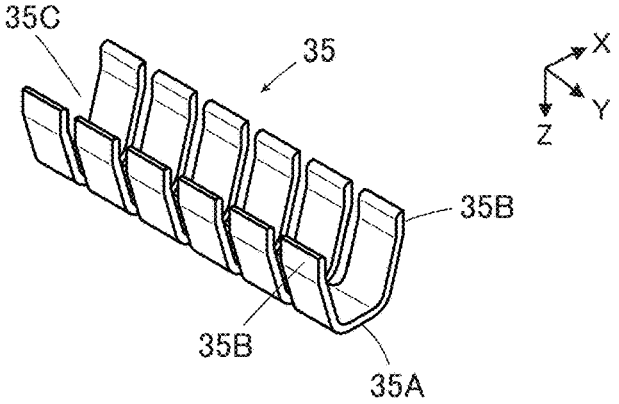
FIG. 26 is a perspective view of the support member used in the connector according to Embodiment 2 as viewed obliquely from below.

As shown in FIG. 25 and FIG. 26, the support member 35 is made of elastically deformable resin or metal, and has a base portion 35A extending linearly along the Y direction and a plurality of pairs of cantilever-shaped elastic pieces 35B connected to the base portion 35A and extending from the base portion 35A in the −Z direction. The plurality of pairs of elastic pieces 35B are arranged in the Y direction. The two elastic pieces 35B forming each pair face each other in the X direction, and are inclined to the Z direction so that a distance therebetween in the X direction increases toward the −Z direction. In a space surrounded by the plurality of pairs of elastic pieces 35B, a recessed projection inserting portion 35C extending in the Y direction and opening in the −Z direction is formed. The plurality of pairs of elastic pieces 35B correspond to the plurality of contacts 33 arranged in two rows of the contact unit 51.

The two elastic pieces 35B forming each pair have a width W3 in the X direction between outer surfaces of the two elastic pieces 35B facing in opposite directions to each other at their −Z directional ends. The width W3 between the outer surfaces of the two elastic pieces 35B is set to be smaller than a value obtained by subtracting twice the thickness of the flexible conductor 43 from the width W1 in the X direction at the −Z directional end of the support member accommodating portion 53 of the contact unit 51.

Further, the two elastic pieces 35B forming each pair have a width W4 in the X direction between inner surfaces of the two elastic pieces 35B facing each other at their −Z directional ends. The width W4 between the inner surfaces of the two elastic pieces 35B is set to be smaller than the width W2 in the X direction at the −Z directional end of the projection 34C of the base member 34.

Further, the support member 35 is to be accommodated in the support member accommodating portion 53 of the contact unit 51, and has a length in the Y direction slightly shorter than a length of the support member accommodating portion 53 of the contact unit 51 in the Y direction.

The projection 34C of the base member 34 is to be inserted into the projection inserting portion 35C of the support member 35, and has a length in the Y direction substantially equal to the length of the support member 35 in the Y direction.

Figure 27:
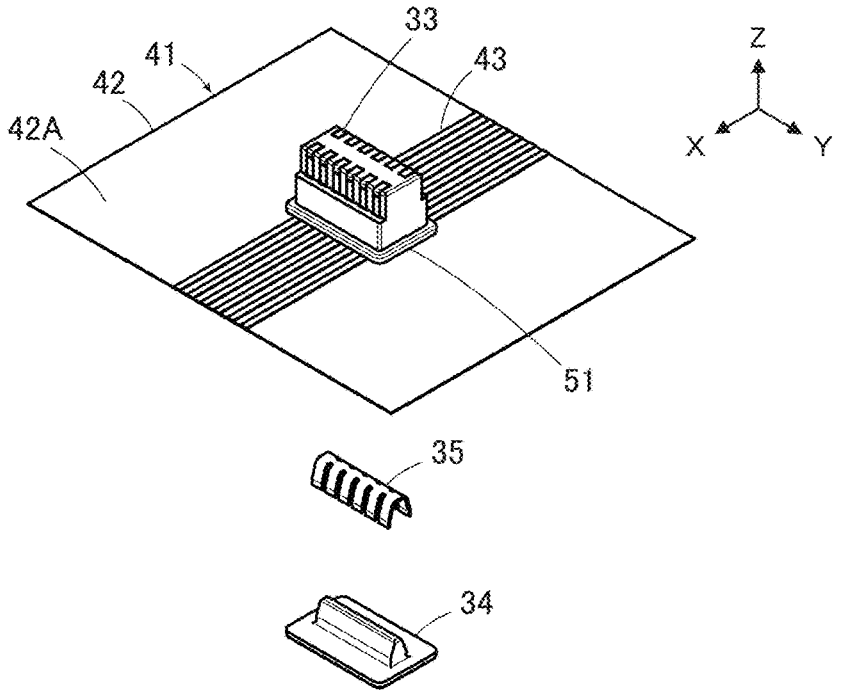
FIG. 27 is an assembly view of a stage in which the contact unit is disposed on a flexible substrate as viewed obliquely from above.

When the connector 31 is attached to the flexible substrate 41, first, as shown in FIG. 27, the contact unit 51 is disposed on the top surface 42A of the substrate body 42 of the flexible substrate 41. At this time, the contact unit 51 is disposed immediately above the cut 44 of the flexible substrate 41 and on the plurality of flexible conductors 43.

Figure 28:
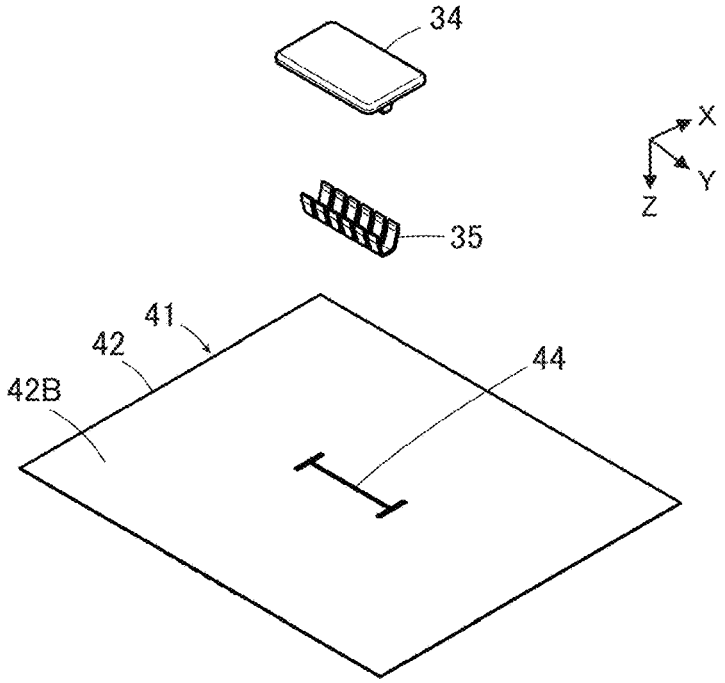
FIG. 28 is an assembly view of the stage in which the contact unit is disposed on the flexible substrate as viewed obliquely from below.
Figure 29:
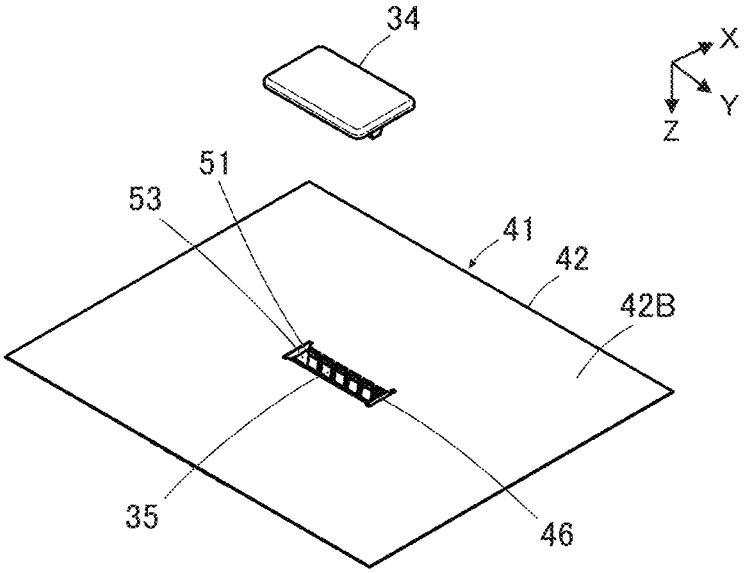
FIG. 29 is an assembly view of a stage in which the support member is accommodated in a support member accommodating portion of the contact unit as viewed obliquely from below.

Next, as shown in FIG. 28, the support member 35 is moved from the −Z direction toward the cut 44 in the rear surface 42B of the substrate body 42 of the flexible substrate 41, and as shown in FIG. 29, the support member 35 is inserted into the support member accommodating portion 53 of the contact unit 51 through the cut 44.

Figure 30:
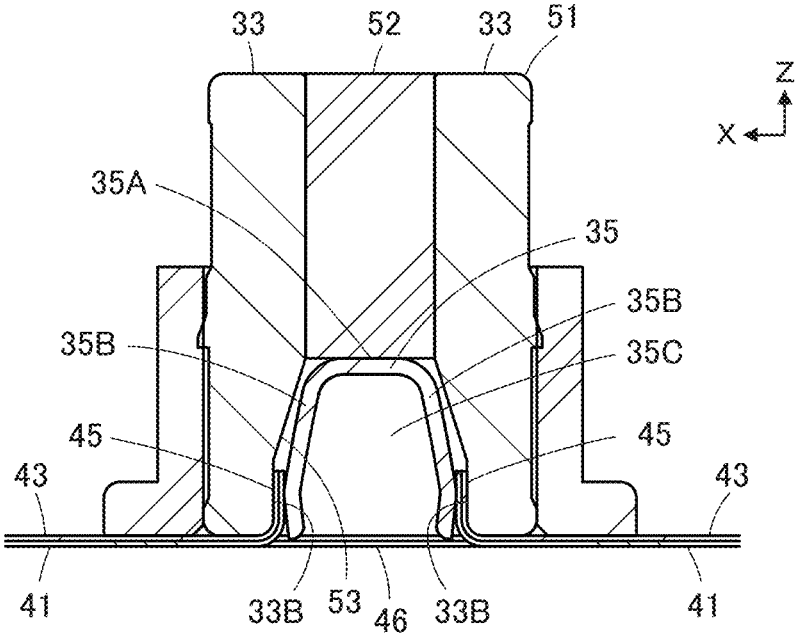
FIG. 30 is a sectional view showing a state in which the support member is accommodated in the support member accommodating portion of the contact unit.

Consequently, as shown in FIG. 30, the contact point portion 45 of the flexible conductor 43 disposed on the +X direction side of the cut 44 and the contact point portion 45 of the flexible conductor 43 disposed on the −X direction side of the cut 44 are bent in the +Z direction and inserted into the support member accommodating portion 53 of the contact unit 51 together with the support member 35, and are disposed to be sandwiched between the outer surfaces of the two elastic pieces 35B forming a pair in the support member 35 and the support member facing portions 33B of the corresponding two contacts 33.

Here, since the width W3 in the X direction between the outer surfaces of the two elastic pieces 35B forming the pair in the support member 35 is set to be smaller than the value obtained by subtracting twice the thickness of the flexible conductor 43 from the width W1 in the X direction at the −Z directional end of the support member accommodating portion 53 of the contact unit 51, both of the contact point portions 45 of the two flexible conductors 43 disposed on both sides in the X direction of the support member 35 are smoothly inserted into the support member accommodating portion 53 without being rubbed by receiving large force from the support member 35.

The base portion 35A of the support member 35 inserted into the support member accommodating portion 53 of the contact unit comes into contact with a bottom of the support member accommodating portion 53 at a +Z directional end thereof, and substantially the entire support member 35 is accommodated in the support member accommodating portion 53.

Further, by inserting the support member 35 into the cut 44 from the −Z direction, the contact point portions 45 of the two flexible conductors 43 disposed on both sides of the cut 44 in the X direction are bent in the +Z direction and inserted into the support member accommodating portion 53 of the contact unit 51. As a result, as shown in FIGS. 29 and 30, an opening 46 is formed in the flexible substrate 41.

Further, through the opening 46 of the flexible substrate 41, the projection 34C of the base member 34 is inserted from the −Z direction into the recessed projection inserting portion 35C of the support member 35, and the base member 34 is bonded to the rear surface 42B of the substrate body 42 of the flexible substrate 41 with an adhesive. The flexible substrate 41 and the contact unit 51 are also bonded with an adhesive. Thus, a mounting process of the connector 31 onto the flexible substrate 41 is completed.

Figure 31:
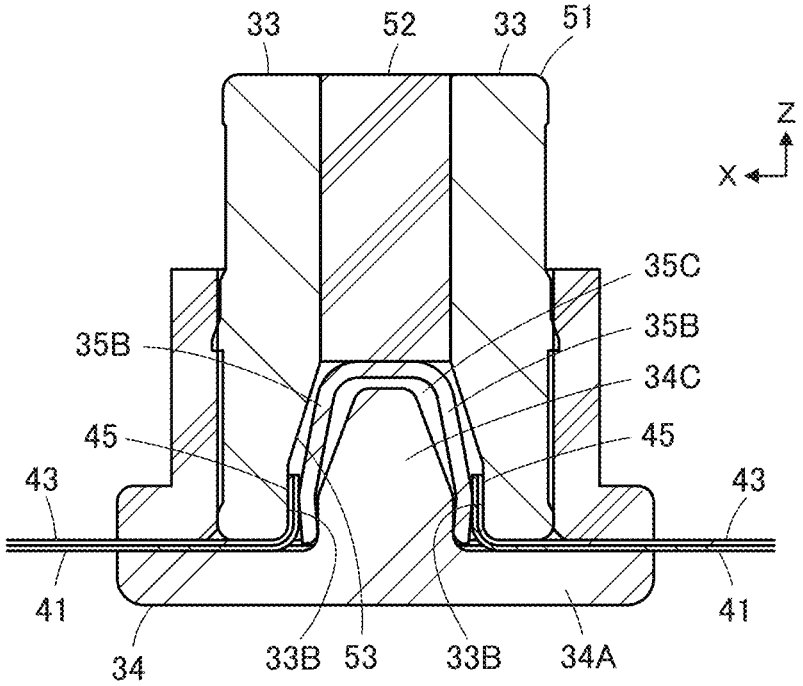
FIG. 31 is a sectional view taken along line A-A in FIG. 18.

FIG. 31 shows the connector 31 that has been mounted on the flexible substrate 41 in this manner.

Since the width W4 in the X direction between the inner surfaces of the two elastic pieces 35B forming the pair in the support member 35 is set to be smaller than the width W2 in the X direction at the −Z directional end of the projection 34C of the base member 34, when the projection 34C is inserted into the projection inserting portion 35C of the support member 35, the two cantilever-shaped elastic pieces 35B forming each pair in the support member 35 are elastically deformed to be expanded. Accordingly, the contact point portions 45 of the two flexible conductors 43 sandwiched between the outer surfaces of the two elastic pieces 35B forming the pair in the support member 35 and the corresponding support member facing portions 33B of the two contacts 33 receive pressing force from the corresponding elastic pieces 35B toward the support member facing portions 33B of the contacts 33.

In other words, a lateral surface of the projection 34C of the base member 34 inserted into the projection inserting portion 35C of the support member 35 presses the contact point portions 45 of both the flexible conductors 43 toward the corresponding support member facing portions 33B of the contacts via the support member 35. As a result, the plurality of contacts 33 of the contact unit 51 are electrically connected to the plurality of flexible conductors 43.

Here, when the projection 34C of the base member 34 is inserted into the projection inserting portion 35C of the support member 35, an inner surface of the projection inserting portion 35C and the lateral surface of the projection 34C rub against each other. However, the contact point portion 45 of each of the flexible conductors 43 only receives the pressing force by being sandwiched between the outer surface of the corresponding elastic piece 35B of the support member 35 and the support member facing portion 33B of the corresponding contact 33, and is not rubbed against any of the lateral surface of the projection 34C, the outer surface of the elastic piece 35B, and the support member facing portion 33B.

As described above, with the connector 31 according to Embodiment 2, even when the contact point portions 45 of the plurality of flexible conductors 43 are inserted into the support member accommodating portion 53 of the contact unit 51 together with the support member 35, and even when the projection 34C of the base member 34 is inserted into the projection inserting portion 35C of the support member 35, the contact point portions 45 of the plurality of flexible conductors 43 are not rubbed by receiving large force. Therefore, the flexible conductors 43 are prevented from being damaged, and reliability of electrical connection between the plurality of flexible conductors 43 and the plurality of contacts 33 can be ensured.

According to Embodiment 2, the plurality of contacts 33 of the contact unit 51 are electrically connected to the plurality of flexible conductors 43 of the flexible substrate 41 using one support member 35 and one base member 34, so that the multi-core connector 31 can be realized.

In Embodiment 2 above, the plurality of contacts 33 of the contact unit 51 are arranged in two rows, but the plurality of contacts 33 may be arranged in one row.

Further, in Embodiment 2 above, the connector 31 is mounted on the flexible substrate 41 in which the flexible conductors 43 are supported by the insulating substrate body 42, but the present invention is not limited thereto. A connector connected to the plurality of flexible conductors 43 independently disposed between the plurality of elastic pieces 35B of the support member 35 and the support member facing portions 33B of the plurality of contacts 33 of the contact unit 51 without being supported by an insulating substrate body may be configured in the same manner.

Embodiment 3

Figure 32:
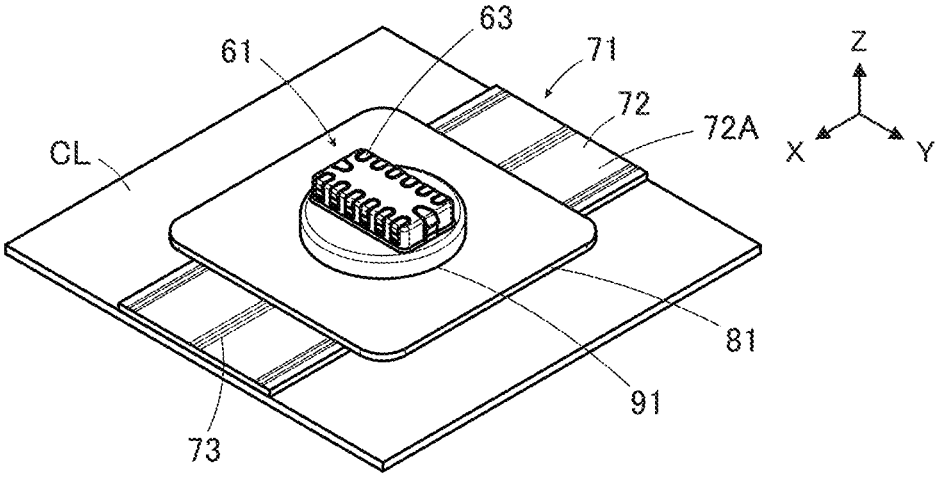
FIG. 32 is a perspective view of a connector according to Embodiment 3 as viewed obliquely from above.
Figure 33:
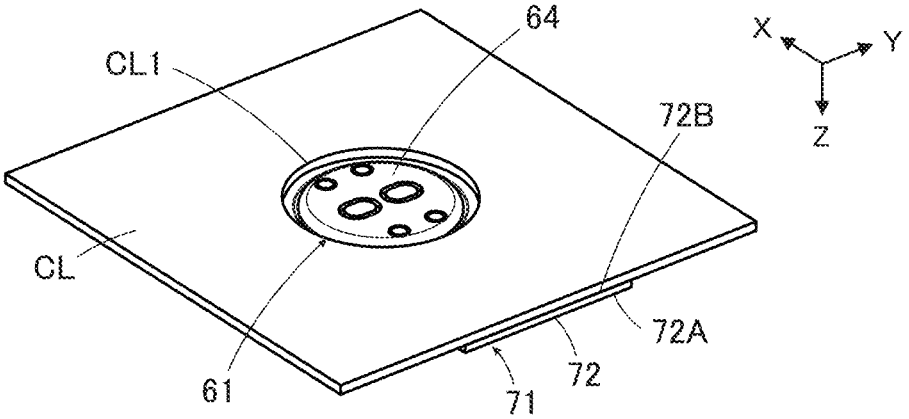
FIG. 33 is a perspective view of the connector according to Embodiment 3 as viewed obliquely from below.

FIGS. 32 and 33 show a connector 61 according to Embodiment 3. Like the connector 11 of Embodiment 1 and the connector 31 of Embodiment 2, the connector 61 is used, for example, as a garment-side connector portion for fitting a wearable device, and is attached to a flexible substrate 71 mounted on a cloth CL of a garment.

The connector 61 includes a contact unit 91 disposed on a surface of the flexible substrate 71 via a sheet-shaped connector fixing member 81 and having a plurality of contacts 63 and a base member 64 facing the contact unit 91 with the flexible substrate 71 being sandwiched therebetween. As shown in FIG. 33, the base member 64 is disposed inside a circular opening CL1 formed in the cloth CL.

The flexible substrate 71 has a sheet-shaped substrate body made of an insulating material and extending along an arrangement plane with an XY plane being defined as the arrangement plane, and the substrate body 72 has a top surface 72A facing in a +Z direction and a rear surface 72B facing in a −Z direction. A plurality of flexible conductors 73 are disposed to be exposed on the top surface 72A of the substrate body 72. The plurality of flexible conductors 73 are, for example, band-like or thread-like conductors made of conductive fiber, extend in an X direction, and are arranged in a Y direction parallel to each other.

Further, the flexible conductors 73 can also be formed of conductive paste applied onto the top surface 72A of the substrate body 72 by printing or the like.

The contact unit 91 is disposed to protrude above the sheet-shaped connector fixing member 81.

Here, for convenience, the top surface 72A of the substrate body 72 of the flexible substrate 71 and the connector fixing member 81 are defined as extending along the XY plane, and a direction in which the contact unit 91 protrudes is referred to as the +Z direction.

Figure 34:
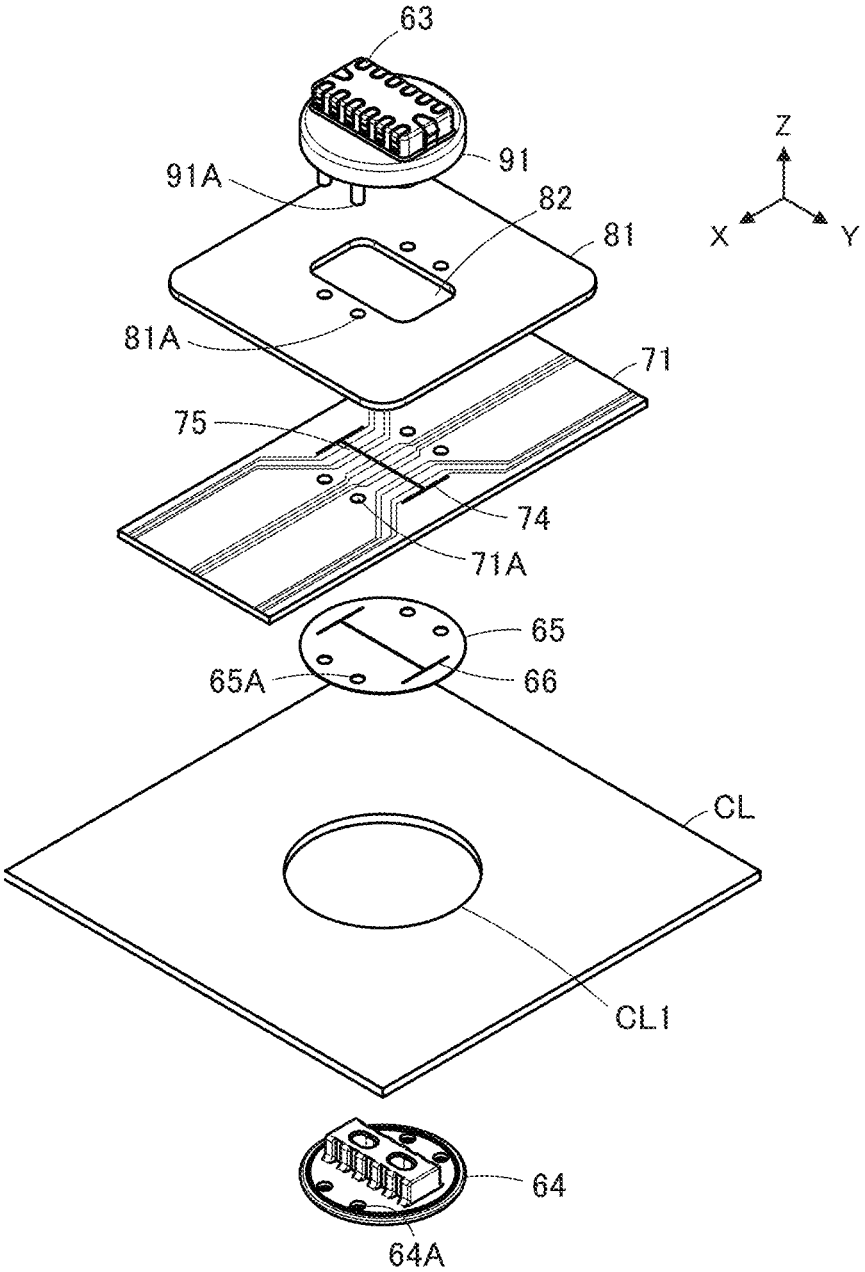
FIG. 34 is an assembly view of the connector according to Embodiment 3 as viewed obliquely from above.
Figure 35:
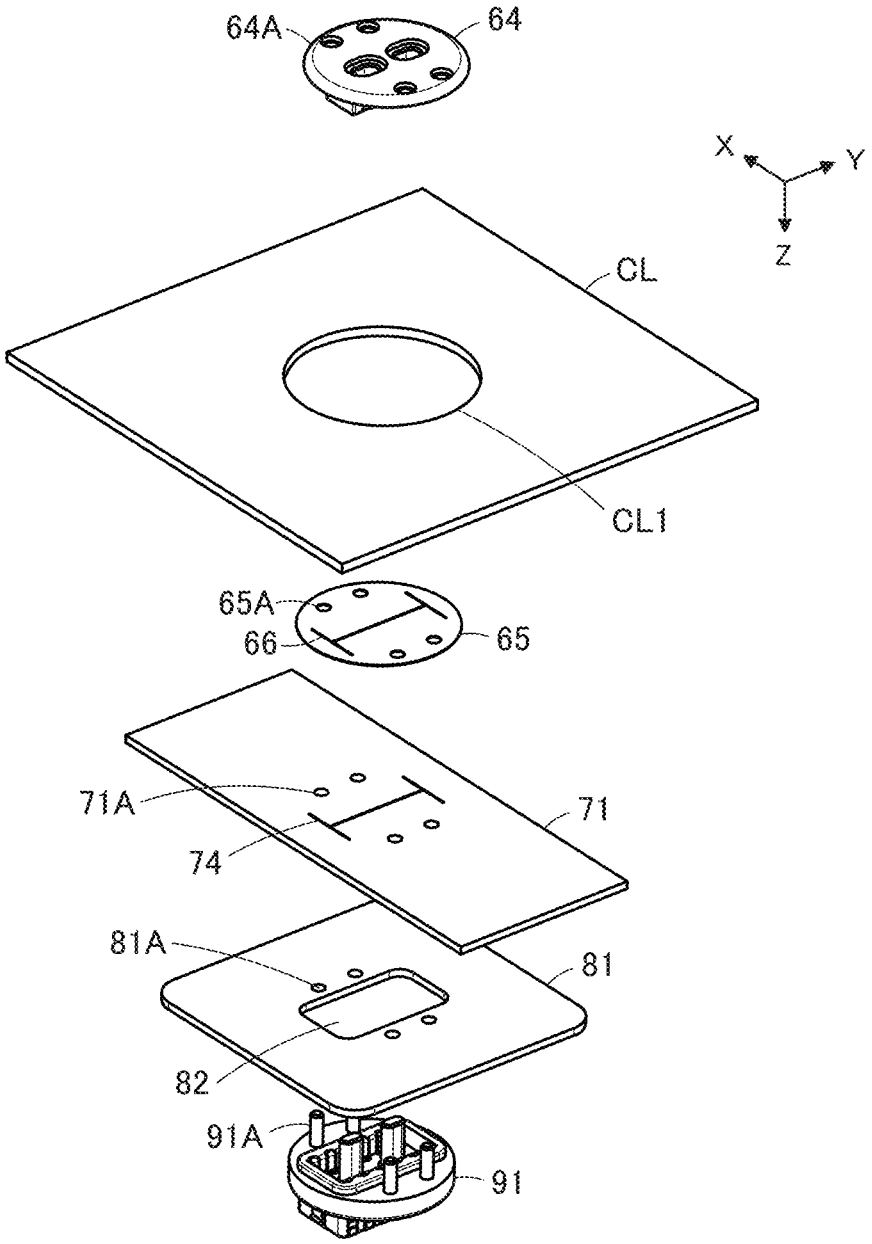
FIG. 35 is an assembly view of the connector according to Embodiment 3 as viewed obliquely from below.

FIGS. 34 and 35 show assembly views of the connector 61. The flexible substrate 71 is disposed on a −Z direction side of the contact unit 91 via the connector fixing member 81. The flexible substrate 71 has an H-shaped cut 74, and the plurality of flexible conductors 73 are disposed on the top surface 72A of the substrate body 72 on a +X direction side and a −X direction side of the cut 74. One end of each flexible conductor 73 extends to the cut 74 to form a bendable contact point portion 75. The connector fixing member 81 has a substantially rectangular opening 82 corresponding to the cut 74 of the flexible substrate 71.

A support sheet 65 is disposed on the −Z direction side of the flexible substrate 71, and the base member 64 is disposed on the −Z direction side of the support sheet 65 via the opening CL1 of the cloth CL.

An H-shaped cut 66 is formed in the support sheet 65 to correspond to the cut 74 of the flexible substrate 71.

The contact unit 91 has four fixing pins 91A protruding in the −Z direction, and four through-holes 81A, four through-holes 71A, four through-holes 65A, and four through-holes 64A are formed in the connector fixing member 81, the flexible substrate 71, the support sheet 65, and the base member 64, respectively. These through-holes 81A, 71A, 65A, and 64A correspond to the four fixing pins 91A of the contact unit 91, and the contact unit 91, the connector fixing member 81, the flexible substrate 71, the support sheet 65, and the base member 64 are disposed such that the through-holes 81A, 71A, 65A, and 64A are aligned with the fixing pins 91A in the Z direction.

Figure 36:
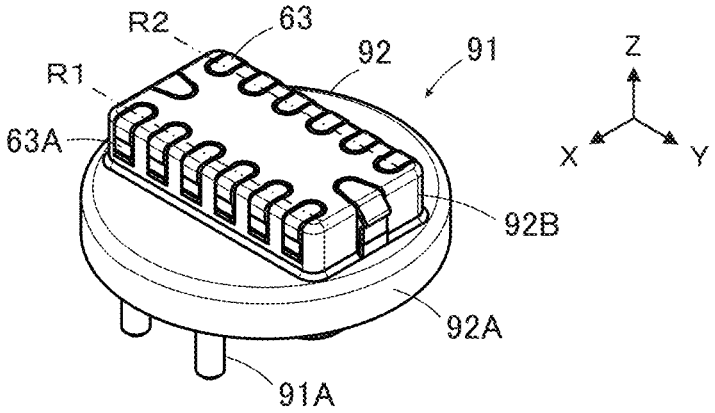
FIG. 36 is a perspective view of a contact unit used in the connector according to Embodiment 3 as viewed obliquely from above.
Figure 37:
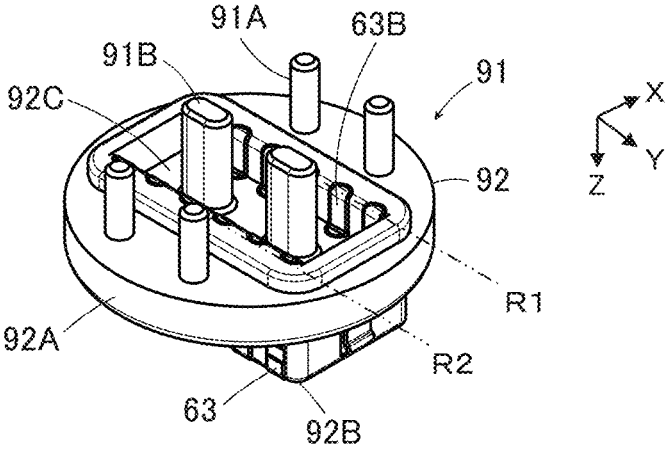
FIG. 37 is a perspective view of the contact unit used in the connector according to Embodiment 3 as viewed obliquely from below.

As shown in FIGS. 36 and 37, the contact unit 91 is configured such that the plurality of contacts 63 arranged in two rows including a first row R1 and a second row R2 are held by a housing 92. The plurality of contacts 63 forming the rows of the first row R1 and the second row R2 are aligned in the Y direction, and a plurality of contacts 63 forming the first row R1 and a plurality of contacts 63 forming the second row R2 are arranged to be adjacent to each other in the X direction.

The housing 92 has a disk-shaped flat plate portion 92A extending along the XY plane and a rectangular parallelepiped protruding portion 92B protruding from the flat plate portion 92A in the +Z direction and extending in the Y direction. A recessed projection accommodating portion 92C extending in the Y direction and opening in the −Z direction is formed inside the protruding portion 92B.

Figure 38:
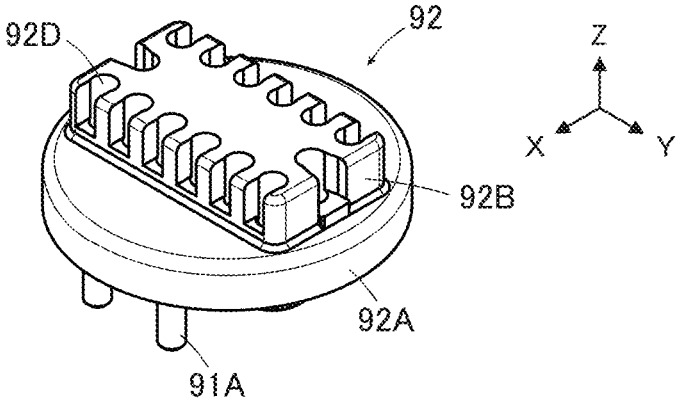
FIG. 38 is a perspective view showing a housing that is a constituent of the contact unit used in the connector according to Embodiment 3.

As shown in FIG. 38, the housing 92 has a plurality of contact accommodating grooves 92D arranged along the Y direction at a +X directional end and a −X directional end of the protruding portion 92B. Each contact accommodating groove 92D extends from a +Z directional end of the protruding portion 92B in the −Z direction, and extends to the projection accommodating portion 92C through the housing 92.

Figure 39:
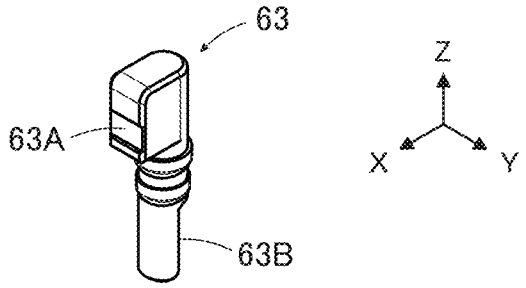
FIG. 39 is a perspective view showing a contact that is a constituent of the contact unit used in the connector according to Embodiment 3.
Figure 40:
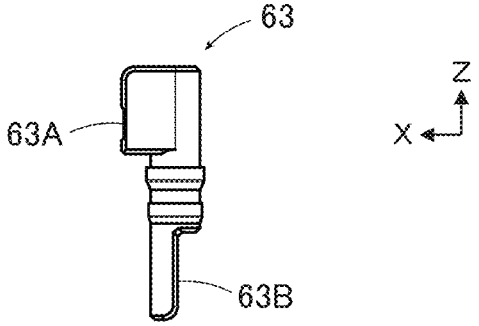
FIG. 40 is a side view showing the contact that is a constituent of the contact unit used in the connector according to Embodiment 3.

The contact 63 shown in FIGS. 39 and 40 is press-fitted and held in the thus formed contact accommodating groove 92D. FIG. 39 and FIG. 40 show the contact 63 that is a constituent of the first row R1. The contact 63 is a pin-shaped member extending along the Z direction, and has at its +Z directional end a counter connector contact surface 63A facing in the +X direction and at its −Z directional end a planar conductor contact surface 63B facing in the −X direction and extending along a YZ plane.

The contact 63 being a constituent of the second row R2 is the same as the contact 63 being a constituent of the first row R1 and is disposed such that the counter connector contact surface 63A faces in the −X direction and the conductor contact surface 63B faces in the +X direction.

When the plurality of contacts 63 are held in the plurality of contact accommodating grooves 92D, as shown in FIGS. 36 and 37, the counter connector contact surfaces 63A of the plurality of contacts 63 forming the first row R1 are exposed from the protruding portion 92B and face in the +X direction, and the counter connector contact surfaces 63A of the plurality of contacts 63 forming the second row R2 are exposed from the protruding portion 92B and face in the −X direction.

In addition, the conductor contact surfaces 63B of the plurality of contacts 63 forming the first row R1 are exposed inside the projection accommodating portion 92C and face in the −X direction, and the conductor contact surfaces 63B of the plurality of contacts 63 forming the second row R2 are exposed inside the projection accommodating portion 92C and face in the +X direction. In other words, the conductor contact surfaces 63B of the plurality of contacts 63 forming the first row R1 and the conductor contact surfaces 63B of the plurality of contacts 63 forming the second row R2 face each other in the X direction across the projection accommodating portion 92C.

Further, as shown in FIG. 37, the four fixing pins 91A protrude in the −Z direction from a surface of the flat plate portion 92A on the −Z direction side. Also, two fixing pins 91B protrude in the −Z direction from a ceiling surface facing in the −Z direction inside the projection accommodating portion 92C, and extend in the −Z direction beyond the surface of the flat plate portion 92A on the −Z direction side.

Figure 41:
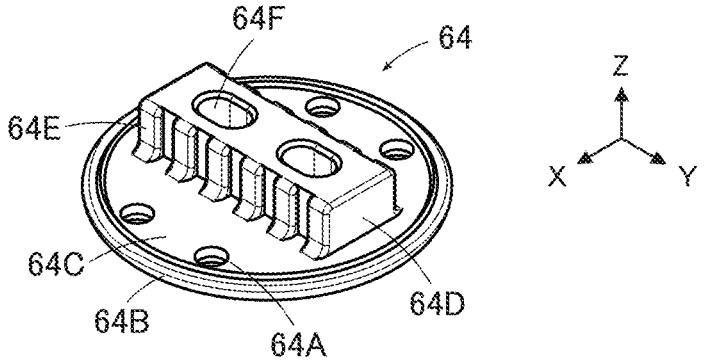
FIG. 41 is a perspective view showing a base member used in the connector according to Embodiment 3.

As shown in FIG. 41, the base member 64 is made of an insulating material such as insulating resin and has a disk-shaped flat plate portion 64B. The flat plate portion 64B has a diameter substantially the same as a diameter of the disk-shaped flat plate portion 92A of the housing 92, and a projection 64D common to the plurality of contacts 63 of the contact unit 91 is formed on a surface 64C of the flat plate portion 64B facing in the +Z direction. The projection 64D has a substantially rectangular parallelepiped shape extending in the Y direction and protruding in the +Z direction. On a lateral surface of the projection 64D at a +X directional end thereof, a plurality of protrusions 64E protruding in the +X direction and extending in the Z direction are formed to correspond to the plurality of contacts 63 forming the first row R1. On a lateral surface of the projection 64D at a −X directional end thereof, a plurality of protrusions 64E protruding in the −X direction and extending in the Z direction are formed to correspond to the plurality of contacts 63 forming the second row R2.

The four through-holes 64A of the base member 64 are formed to penetrate the flat plate portion 64B in the Z direction, and two through-holes 64F penetrating in the Z direction are also formed in the projection 64D.

As shown in FIGS. 34 and 35, the support sheet 65 has a disk shape having a diameter substantially equal to the diameters of the disk-shaped flat plate portion 92A of the housing 92 and the disk-shaped flat plate portion 64B of the base member 64. The support sheet 65 is made of an elastically deformable material, and is held between the substrate body 72 of the flexible substrate 71 and the flat plate portion 64B of the base member 64. When the contacts 63 are electrically connected to the flexible conductors 73, a portion near the cut 66 of the support sheet 65 is sandwiched between the protrusion 64E of the base member 64 and the substrate body 72 of the flexible substrate 71.

The connector fixing member 81 is sandwiched between the contact unit 91 and the flexible substrate 71, and by fixing the connector fixing member 81 to the cloth CL of the garment, the connector 61 is attached to the garment.

As shown in FIGS. 34 and 35, the rectangular opening 82 is formed at the center of the connector fixing member 81, and the four through-holes 81A are disposed along a periphery of the opening 82.

When the connector 61 is attached to the flexible substrate 71, first, the connector fixing member 81, the flexible substrate 71, and the support sheet 65 are moved in the +Z direction and pressed against the contact unit 91, while the four fixing pins 91A protruding from the contact unit 91 in the −Z direction are sequentially inserted into the four through-holes 81A of the connector fixing member 81, the four through-holes 71A of the flexible substrate 71, and the four through-holes 65A of the support sheet 65.

At this time, as shown in FIG. 37, the contact unit 91 has the two fixing pins 91B protruding in the −Z direction beyond the surface of the flat plate portion 92A on the −Z direction side, and these two fixing pins 91B are located on a +Z direction side of the cut 74 of the flexible substrate 71 and the cut 66 of the support sheet 65 through the opening 82 of the connector fixing member 81. Therefore, the H-shaped cuts 74 and are pushed open by the two fixing pins 91B of the contact unit 91, and a portion near the cut 74 of the flexible substrate 71 and the portion near the cut 66 of the support sheet 65 are pushed by the two fixing pins 91B and bent in the −Z direction while being overlapped with each other.

Figure 42:
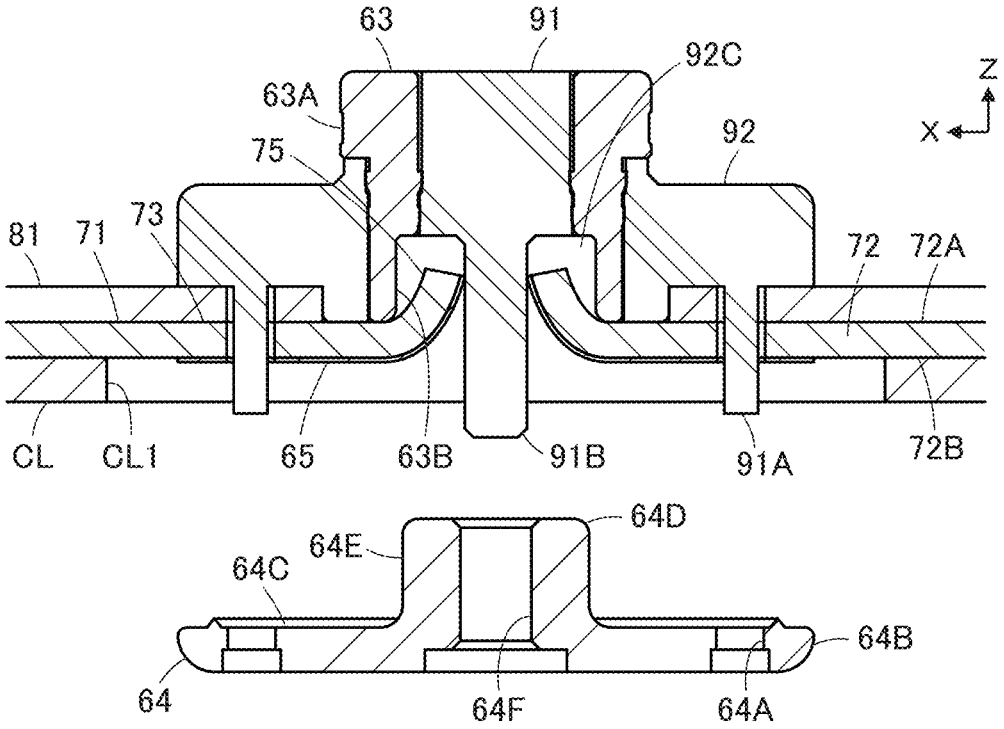
FIG. 42 is a sectional view showing a state in which the base member is aligned with the contact unit disposed on a flexible substrate.

Here, as shown in FIG. 42, for example, by using a pin-shaped jig (not shown), the portion near the cut 74 of the flexible substrate 71 and the portion near the cut 66 of the support sheet 65 are pushed in the +Z direction and bent toward the inside of the projection accommodating portion 92C of the housing 92.

At this time, a surface of the support sheet 65 facing in the −Z direction and −Z directional ends of the fixing pins 91A and 91B of the contact unit 91 are exposed in the −Z direction inside the opening CL1 of the cloth CL disposed on the −Z direction side of the flexible substrate 71.

Figure 43:
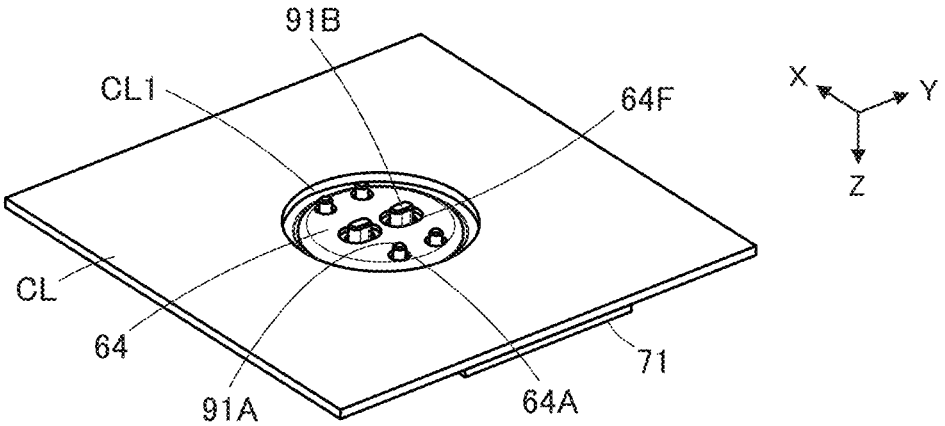
FIG. 43 is a perspective view of a state in which the base member is pushed into the contact unit as viewed obliquely from below.

In this state, the base member 64 is moved in the +Z direction and pressed against the contact unit 91 via the support sheet 65, the flexible substrate 71, and the connector fixing member 81. Consequently, as shown in FIG. 43, the four fixing pins 91A of the contact unit 91 protrude in the −Z direction through the four through-holes 64A of the base member 64, and the two fixing pins 91B of the contact unit 91 protrude in the −Z direction through the two through-holes 64F of the base member 64.

The −Z directional ends of the four fixing pins 91A and the two fixing pins 91B of the contact unit 91 protruding from the base member 64 in the −Z direction are thermally deformed and upset to thereby fix the base member 64 to the connector unit 91, and an attachment process of the connector 61 to the flexible substrate 71 is completed.

Figure 44:
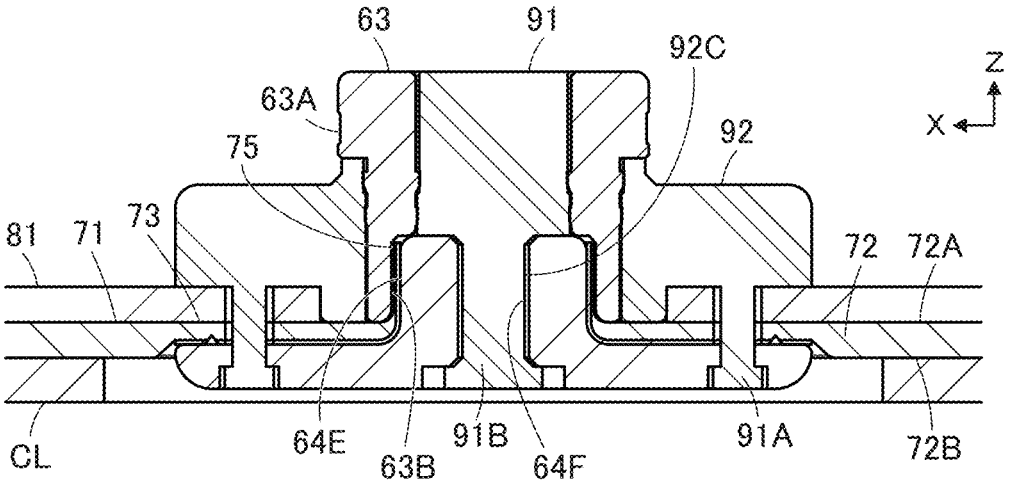
FIG. 44 is a sectional view showing the connector according to Embodiment 3.

FIG. 44 shows the connector 61 that has been mounted on the flexible substrate 71 in this manner.

The projection 64D of the base member 64 is inserted into the projection accommodating portion 92C of the housing 92, and in the projection accommodating portion 92C, a part of the flexible substrate 71 and a part of the support sheet 65 are bent in the +Z direction orthogonal to the XY plane which is the arrangement plane of the flexible substrate 71 while being overlapped with each other; in this state, the part of the flexible substrate 71 and the part of the support sheet 65 are compressed in the X direction by being sandwiched between the protrusion 64E of the projection 64D of the base member 64 and the conductor contact surface 63B of the contact 63 corresponding to the protrusion 64E. Consequently, the contact point portion 75 of the flexible conductor 73 disposed on the top surface 72A of the substrate body 72 of the flexible substrate 71 receives a pressing force acting from the corresponding protrusion 64E toward the conductor contact surface 63B of the corresponding contact 63 via the support sheet 65 and the substrate body 72 of the flexible substrate 71, and is electrically connected to the conductor contact surface 63B.

In this way, the plurality of contacts 63 arranged in two rows in the contact unit 91 are electrically connected to the plurality of flexible conductors 73 of the flexible substrate 71.

The part of the flexible substrate 71 is compressed in the X direction by being sandwiched between the protrusion 64E of the base member 64 and the conductor contact surface 63B of the contact 63, so that the flexible substrate 71 is elastically compressed and deformed in the X direction. As a result, contact pressure of the contact point portion 75 of the flexible conductor 73 against the conductor contact surface 63B is generated by reaction force of the compression deformation, and the flexible conductor 73 is electrically connected to the contact 63 with high reliability.

Further, since the support sheet 65 is sandwiched together with the flexible substrate 71 between the protrusion 64E of the base member 64 and the conductor contact surface 63B of the contact 63, the support sheet 65 is also elastically compressed and deformed in the X direction. Therefore, for example, when the support sheet 65 is made of a material having high elasticity such as rubber or elastomer such that the support sheet 65 is provided with elastic force larger than elastic force of the flexible conductor 73, even on a thin flexible substrate 71 with poor elastic force, contact pressure of the contact point portion 75 of the flexible conductor 73 against the conductor contact surface 63B is generated by reaction force of the compression deformation of the support sheet 65, and the flexible conductor 73 can be electrically connected to the contact 63 with high reliability.

Here, in electrically connecting the plurality of contacts to the plurality of flexible conductors 73, although the support sheet 65 rubs against the projection 64D of the base member 64, the contact point portions 75 of the flexible conductors 73 receive only pressing force in the X direction orthogonal to the conductor contact surfaces 63B of the contacts 63 from the corresponding protrusions 64E of the base member 64 via the support sheet 65 and the substrate body 72 of the flexible substrate 71, and do not rub against either the protrusions 64E or the conductor contact surfaces 63B.

As a result, the flexible conductors 73 are prevented from being damaged, and reliability of electrical connection between the plurality of flexible conductors 73 and the plurality of contacts 63 can be ensured.

In addition, when the support sheet 65 is made of a material having a high sliding property, such as a polyethylene terephthalate (PET) film, the projection 64D of the base member can be easily inserted into the projection accommodating portion 92C of the housing 92. Thus, the connector 61 can be efficiently attached to the flexible substrate 71.

In this case, the support sheet 65 preferably has a greater sliding property with respect to the base member 64 than a sliding property of the flexible substrate 71, for example.

Figure 45:
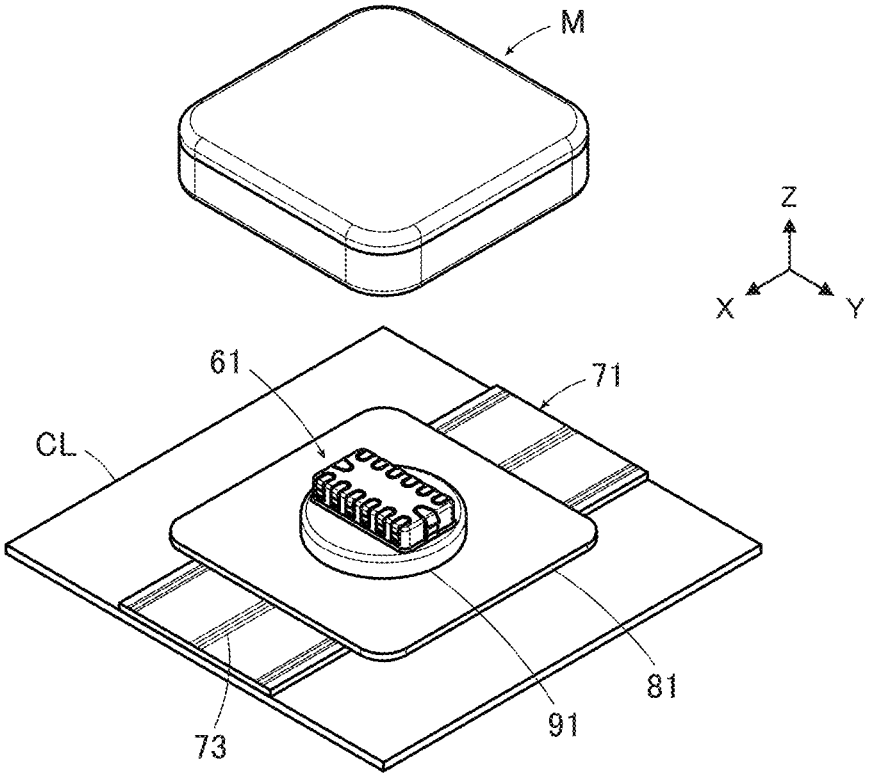
FIG. 45 is a perspective view of a state in which an electronic circuit module including a counter connector is aligned with the connector according to Embodiment 3 as viewed obliquely from above.
Figure 46:
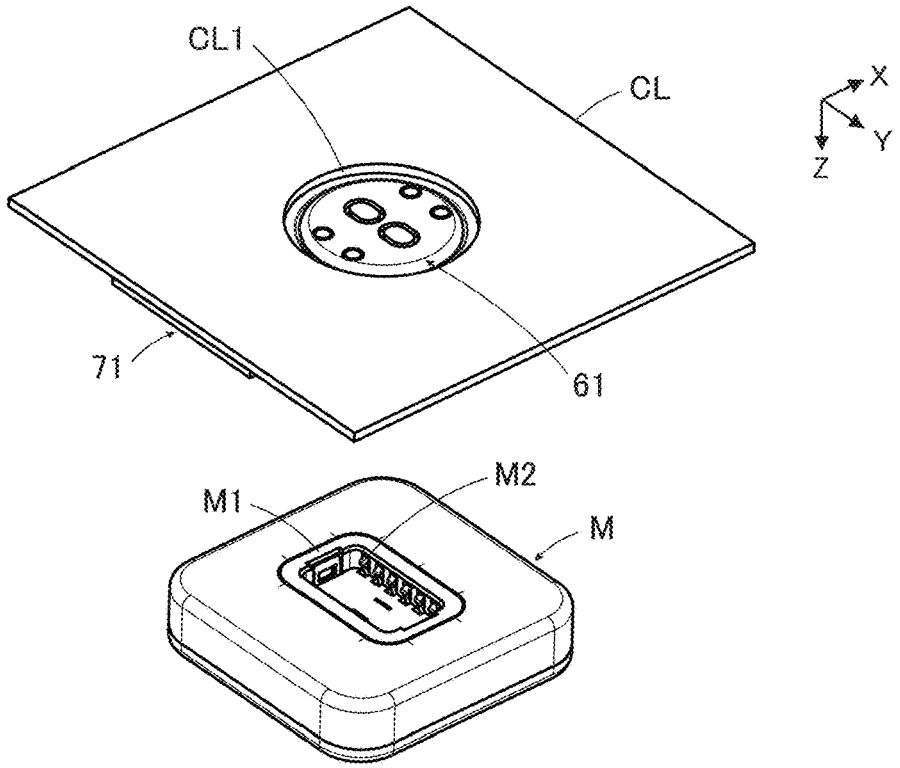
FIG. 46 is a perspective view of the state in which the electronic circuit module including the counter connector is aligned with the connector according to Embodiment 3 as viewed obliquely from below.
Figure 47:
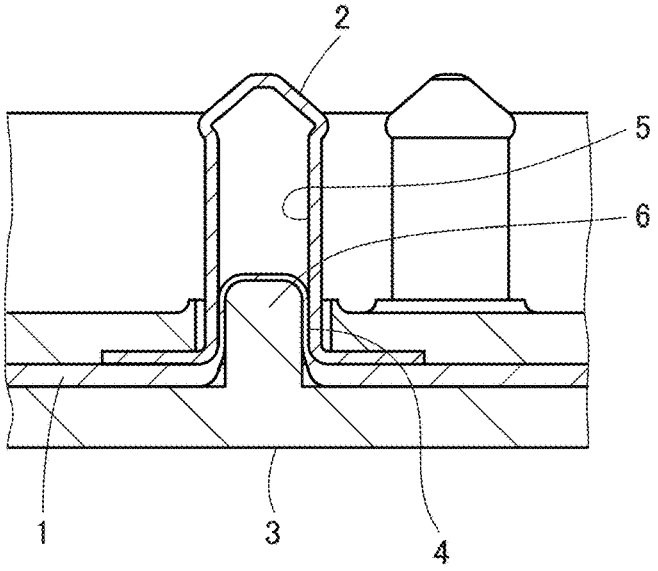
FIG. 47 PRIOR ART
FIG. 47 is a sectional view showing a contact, a projection, and a flexible substrate in a conventional connector.

As shown in FIGS. 45 and 46, an electronic circuit module M including a counter connector M1 is positioned on the +Z direction side of the connector 61 mounted on the flexible substrate 71, the electronic circuit module M is moved in the −Z direction, and the counter connector M1 is fitted to the connector 61, whereby the electronic circuit module M is electrically connected to the plurality of flexible conductors 73 of the flexible substrate 71. At this time, the housing 92 of the contact unit 91 shown in FIG. 44 is fitted to the counter connector M1, and the counter connector contact surfaces 63A of the plurality of contacts 63 come into contact with a plurality of contacts M2 of the counter connector M1 shown in FIG. 46.

According to Embodiment 3, by electrically connecting the plurality of contacts 63 of the contact unit 91 to the plurality of flexible conductors 73 of the flexible substrate 71, the multi-core connector 61 can be realized.

In Embodiment 3 above, the plurality of contacts 63 of the contact unit 91 are arranged in two rows, but the plurality of contacts 63 may be arranged in one row.

Further, in Embodiment 3 above, the connector 61 is mounted on the flexible substrate 71 in which the flexible conductors 73 are supported by the insulating substrate body 72, but the present invention is not limited thereto. A connector connected to the plurality of flexible conductors 73 independently disposed between the support sheet 65 and the conductor contact surfaces 63B of the plurality of contacts 63 of the contact unit 91 without being supported by an insulating substrate body may be configured in the same manner.

In this case, by providing the support sheet 65 with elastic force larger than the elastic force of the flexible conductor 73, contact pressure of the flexible conductor 73 against the conductor contact surface 63B can be ensured owing to reaction force of compression deformation of the support sheet 65, and the flexible conductor 73 can be electrically connected to the contact 63 with high reliability.

Further, by providing the support sheet 65 with a sliding property greater than that of the flexible conductor 73 with respect to the base member 64, the connector 61 can be efficiently attached to the flexible conductor 73.

As described above, the connector 61 according to Embodiment 3 of the present invention is the connector 61 connected to the flexible conductor 73 extending along the XY plane (arrangement plane), and includes the base member 64 (pushing member) having the projection 64D, and the contact 63 having the planar conductor contact surface 63B made of a conductive material and orthogonal to the XY plane and the counter connector contact surface 63A facing in the direction opposite to the conductor contact surface 63B and contacting the contact of the counter connector M1. A part of the flexible conductor 73 is disposed between the projection 64D and the conductor contact surface 63B of the contact 63 in a state of being bent in a direction orthogonal to the XY plane. When the protrusion 64E formed on the lateral surface of the projection 64D presses the part of the flexible conductor 73 against the conductor contact surface 63B of the contact 63, the contact 63 is electrically connected to the flexible conductor 73.

While the plug-type contacts 13, 33, 63 are used in Embodiments 1 to 3 above, the present invention is not limited thereto, and a connector may be configured such that receptacle-type contacts are connected to the flexible conductors 21, 43, 73 in the same manner.

What is claimed is:

1. A connector to be connected to a flexible conductor, comprising:

a pushing member having a projection;

a contact made of a conductive material; and a support member disposed between the projection and the contact to contact a lateral surface of the projection, wherein the contact has a support member facing portion facing the support member, wherein a part of the flexible conductor is disposed between the support member and the support member facing portion of the contact, and the lateral surface of the projection presses the part of the flexible conductor against the support member facing portion of the contact via the support member, whereby the contact is electrically connected to the flexible conductor.

2. The connector according to claim 1, wherein the support member is elastically deformable and has a projection inserting portion in a recessed shape into which the projection is inserted, and the lateral surface of the projection inserted in the projection inserting portion of the support member presses the part of the flexible conductor against the support member facing portion of the contact via the support member.

3. The connector according to claim 2, wherein the contact has a support member accommodating portion in a recessed shape in which the support member is accommodated, and the support member facing portion is formed on an inner surface of the support member accommodating portion.

4. The connector according to claim 3, wherein the support member includes: a base portion that faces a bottom of the support member accommodating portion when the support member is accommodated in the support member accommodating portion; and at least one elastic piece in a cantilever shape that is connected to the base portion and extends along the inner surface of the support member accommodating portion, and the at least one elastic piece is disposed between the lateral surface of the projection and the part of the flexible conductor.

5. The connector according to claim 4, wherein the at least one elastic piece includes a conductor contact portion contacting the part of the flexible conductor when the support member is accommodated in the support member accommodating portion of the contact and the projection is inserted in the projection inserting portion of the support member, and a projection contact portion that is disposed at a position different from the conductor contact portion in a longitudinal direction of the elastic piece along the inner surface of the support member accommodating portion and that contacts the lateral surface of the projection.

6. The connector according to claim 5, wherein an outside dimension of the support member at a position where the conductor contact portion is disposed is smaller than an inside dimension of the support member accommodating portion.

7. The connector according to claim 6, wherein the outside dimension of the support member at the position where the conductor contact portion is disposed is smaller than a value obtained by subtracting a thickness of the flexible conductor from the inside dimension of the support member accommodating portion.

8. The connector according to claim 5, wherein an inside dimension of the support member at a position where the projection contact portion is disposed is smaller than an outside dimension of the projection.

9. The connector according to claim 3, wherein the pushing member is constituted of a base member having a plurality of the parts of a plurality of the flexible conductors are separately disposed between a plurality of the support members and the inner surfaces of the support member accommodating portions of a plurality of the contacts, and the plurality of the projections are inserted into the projection inserting portions of the plurality of the support members.

10. The connector according to claim 9, wherein the contact has a protruding portion and a flange formed at one end of the protruding portion, the connector further includes a housing provided with a contact through-hole through which the protruding portion of the contact passes and which is smaller than the flange, and when the housing is fixed to the base member such that the protruding portion of the contact passes through the contact through-hole and the flange is pressed against the base member, the contact is fixed to the base member.

11. The connector according to claim 10, wherein the housing is made of an insulating material.

12. The connector according to claim 10, wherein the housing has a counter connector accommodating portion in which a part of a counter connector is to be accommodated.

13. The connector according to claim 9, wherein the base member is made of an insulating material.

14. The connector according to claim 1, comprising a contact unit in which a plurality of the contacts are aligned and held by a housing, wherein the pushing member has the projection that is provided singly and is common to the plurality of the contacts, the support member has a plurality of elastic pieces in a cantilever shape corresponding to the plurality of the contacts, and parts of a plurality of the flexible conductors are disposed between the plurality of elastic pieces and the support member facing portions of the plurality of the contacts, and the lateral surface of the projection presses the parts of the plurality of the flexible conductors against the support member facing portions of the plurality of the contacts via the plurality of elastic pieces, whereby the plurality of the contacts are electrically connected to the plurality of the flexible conductors.

15. The connector according to claim 14, wherein the plurality of the flexible conductors extend along a predetermined arrangement plane, and the parts of the plurality of the flexible conductors are pressed against the support member facing portions of the plurality of the contacts by the lateral surface of the projection via the plurality of elastic pieces with the parts of the plurality of the flexible conductors being bent in a direction orthogonal to the arrangement plane.

16. The connector according to claim 1, comprising:

a contact unit in which a plurality of the contacts are aligned and held by a housing, wherein the pushing member has the projection that is provided singly and is common to the plurality of the contacts, and has a plurality of protrusions that correspond to the plurality of the contacts and protrude laterally from the projection, the support member is constituted of a part of a support sheet disposed between the contact unit and the pushing member, and parts of a plurality of the flexible conductors are disposed between the part of the support sheet and the support member facing portions of the plurality of the contacts, and the plurality of protrusions press the parts of the plurality of the flexible conductors against the support member facing portions of the plurality of the contacts via the part of the support sheet, whereby the plurality of the contacts are electrically connected to the plurality of the flexible conductors.

17. The connector according to claim 16, wherein the plurality of the flexible conductors extend along a predetermined arrangement plane, the support member facing portions of the plurality of the contacts each have a conductor contact surface in a planar shape orthogonal to the arrangement plane, each of the plurality of protrusions has a pressing surface in a planar shape orthogonal to the arrangement plane, and the parts of the plurality of the flexible conductors are pressed against the conductor contact surfaces of the support member facing portions of the plurality of the contacts by the pressing surfaces of the plurality of protrusions via the part of the support sheet with the parts of the plurality of the flexible conductors being bent in a direction orthogonal to the arrangement plane.

18. The connector according to claim 16, wherein the support sheet has an elastic force greater than an elastic force of the flexible conductor.

19. The connector according to claim 16, wherein the support sheet has a greater sliding property with respect to the pushing member than a sliding property of the flexible conductor.

20. The connector according to claim 16, wherein the contact has a counter connector contact surface that faces in a direction opposite to the conductor contact surface and is to contact a contact of a counter connector.

21. The connector according to claim 1, wherein the flexible conductor is independently disposed between the support member and the support member facing portion.

22. The connector according to claim 1, wherein the flexible conductor is disposed to be exposed on a top surface of an insulating substrate body, and the flexible conductor is disposed between the support member and the support member facing portion such that the flexible conductor faces the support member facing portion of the contact and a rear surface of the substrate body faces the support member.

23. The connector according to claim 1, wherein the contact is a plug-type contact.

24. The connector according to claim 1, wherein the contact is a receptacle-type contact.

25. A connecting method for connecting a contact to a flexible conductor, comprising:

disposing a support member between a projection of a pushing member and the contact so as to contact a lateral surface of the projection;

disposing a part of the flexible conductor between a support member and the support member facing portion of the contact; and making a lateral surface of a projection of a pushing member contact the support member to allow the lateral surface of the projection to press the part of the flexible conductor against the support member facing portion of the contact via the support member, whereby the contact is electrically connected to the flexible conductor.

* * * * *